US007273408B2

(12) United States Patent
Chen et al.

(10) Patent No.: US 7,273,408 B2
(45) Date of Patent: Sep. 25, 2007

(54) PAIRED PIVOT ARM

(75) Inventors: Hung Chih Chen, Santa Clara, CA (US); Steven M. Zuniga, Soquel, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 11/438,497

(22) Filed: May 22, 2006

(65) Prior Publication Data

US 2007/0141954 A1 Jun. 21, 2007

Related U.S. Application Data

(60) Provisional application No. 60/750,879, filed on Dec. 16, 2005.

(51) Int. Cl.
*B24B 49/00* (2006.01)
*B24B 1/00* (2006.01)

(52) U.S. Cl. ..... 451/11; 451/41

(58) Field of Classification Search ..... 451/11, 451/41, 285–290, 292, 401
See application file for complete search history.

(56) References Cited

U.S. PATENT DOCUMENTS 4,141,180 A 2/1979 Gill, Jr. et al.
5,361,545 A * 11/1994 Nakamura ..... 451/287
5,584,647 A * 12/1996 Uehara et al. ..... 414/744.5
5,649,854 A * 7/1997 Gill, Jr. ..... 451/290
5,804,507 A 9/1998 Perlov et al.
6,045,716 A * 4/2000 Walsh et al. ..... 216/88
6,095,908 A * 8/2000 Torii ..... 451/285
6,155,768 A * 12/2000 Bacchi et al. ..... 414/416.03
6,283,822 B1 * 9/2001 Togawa et al. ..... 451/5
6,343,979 B1 * 2/2002 Peltier et al. ..... 451/285
6,354,922 B1 * 3/2002 Sakurai et al. ..... 451/67
6,354,926 B1 * 3/2002 Walsh ..... 451/285
6,475,914 B2 * 11/2002 Han ..... 438/687
6,629,883 B2 10/2003 Katsuoka et al.
6,817,923 B2 11/2004 Smith
6,942,541 B2 * 9/2005 Togawa et al. ..... 451/5
6,969,305 B2 11/2005 Kimura et al.
2004/0023495 A1 2/2004 Butterfield et al.
2006/0035563 A1 * 2/2006 Kalenian et al. ..... 451/5

* cited by examiner

*Primary Examiner*—M. Rachuba
(74) *Attorney, Agent, or Firm*—Patterson & Sheridan LLP

(57) ABSTRACT

The present invention relates to an apparatus and method for polishing semiconductor substrates. In one embodiment, two polishing heads are mounted on two independent pivoting arms that share one pivot point. Each of the pivoting arms enable the corresponding polishing head direct access to two polishing stations. The polishing system of the present invention provides flexibility and improves throughput.

5 Claims, 19 Drawing Sheets

PAIRED PIVOT ARM

CROSS-REFERENCE TO RELATED APPLICATIONS

This application claims benefit of U.S. Provisional Patent Application Ser. No. 60/750,879 filed Dec. 16, 2005, which is herein incorporated by reference.

BACKGROUND OF THE INVENTION

1. Field of the Invention

Embodiments of the invention generally relate to an apparatus and method for polishing or planarization of semiconductor substrates.

2. Description of the Related Art

Sub-micron multi-level metallization is one of the key technologies for the next generation of ultra large-scale integration (ULSI). The multilevel interconnects that lie at the heart of this technology require planarization of interconnect features formed in high aspect ratio apertures, including contacts, vias, trenches and other features. Reliable formation of these interconnect features is very important to the success of ULSI and to the continued effort to increase circuit density and quality on individual substrates and die.

In the fabrication of integrated circuits and other electronic devices, multiple layers of conducting, semiconducting, and dielectric materials are deposited on or removed from a surface of a substrate. Thin layers of conducting, semiconducting, and dielectric materials may be deposited by a number of deposition techniques. Common deposition techniques in modern processing include physical vapor deposition (PVD), also known as sputtering, chemical vapor deposition (CVD), plasma-enhanced chemical vapor deposition (PECVD), and electro chemical plating (ECP).

As layers of materials are sequentially deposited and removed, the uppermost surface of the substrate may become non-planar across its surface and require planarization. An example of non-planar process is the deposition of copper films with the ECP process in which the copper topography simply follows the already existing non-planar topography of the wafer surface, especially for lines wider than 10 microns. Planarizing a surface, or "polishing" a surface, is a process where material is removed from the surface of the substrate to form a generally even, planar surface. Planarization is useful in removing undesired surface topography and surface defects, such as rough surfaces, agglomerated materials, crystal lattice damage, scratches, and contaminated layers or materials. Planarization is also useful in forming features on a substrate by removing excess deposited material used to fill the features and to provide an even surface for subsequent levels of metallization and processing.

Planarization is generally performed using Chemical Mechanical Polishing (CMP) and/or Electro-Chemical Mechanical Polishing (ECMP). A planarization method typically requires that the substrate be mounted in a wafer head, with the surface of the substrate to be polished exposed. The substrate supported by the head is then placed against a rotating polishing pad. The head holding the substrate may also rotate, to provide additional motion between the substrate and the polishing pad surface. Further, a polishing slurry (typically including an abrasive and at least one chemically reactive agent therein, which are selected to enhance the polishing of the topmost film layer of the substrate) is supplied to the pad to provide an abrasive chemical solution at the interface between the pad and the substrate.

The combination of polishing pad characteristics, the specific slurry mixture, and other polishing parameters can provide specific polishing characteristics. Thus, for any material being polished, the pad and slurry combination is theoretically capable of providing a specified finish and flatness on the polished surface. It must be understood that additional polishing parameters, including the relative speed between the substrate and the pad and the force pressing the substrate against the pad, affect the polishing rate, finish, and flatness. Therefore, for a given material whose desired finish is known, an optimal pad and slurry combination may be selected. Typically, the actual polishing pad and slurry combination selected for a given material is based on a trade off between the polishing rate, which determines in large part the throughput of wafers through the apparatus, and the need to provide a particular desired finish and flatness on the surface of the substrate.

Because the flatness and surface finish of the polished layer is dictated by other processing conditions in subsequent fabrication steps, throughput insofar as it involves polishing rate must often be sacrificed in this trade off. Nonetheless, high throughput is essential in the commercial market since the cost of the polishing equipment must be amortized over the number of wafers being produced. Of course, high throughput must be balanced against the cost and complexity of the machinery being used. Similarly, floor space and operator time required for the operation and maintenance of the polishing equipment incur costs that must be included in the sale price. For all these reasons, a polishing apparatus is needed which has high throughput, is relatively simple and inexpensive, occupies little-floor space, and requires minimal operator control and maintenance.

Multiple polishing steps have been used for polishing the substrate to thereby allow improvement of polishing rate and finish with multiple pad or slurry combinations, hence increasing throughput.

One method provides a main polishing surface and a fine polishing surface in a polishing apparatus. A single polishing head, controlled by a single positioning apparatus, moves a single substrate between the different polishing stations on the apparatus. However, at least one polishing surface is idle at any given time.

Another method provides multiple polishing pads, each pad corresponding to a polishing head, and a substrate handling device moving the substrate being processed among the polishing pads and heads. However, multiple loading and unloading of substrates limits the throughput and also increases the possibility of particle contamination.

Another method of increasing throughput uses a wafer head having a plurality of substrate loading stations therein to simultaneously load a plurality of substrates against a single polishing pad to enable simultaneous polishing of the substrates on the single polishing pad. Although this method would appear to provide substantial throughput increases over the single substrate style of wafer head, several factors militate against the use of such carrier arrangements for planarizing substrates, particularly after deposition layers have been formed thereon. First, the wafer head holding the wafer being polished is complex. To attempt to control the force loading each substrate against the pad, one approach floats the portion of the head holding the wafer. A floating wafer holder necessitates a substantial number of moving parts and pressure lines must be included in the rotating and moving geometry. Additionally, the ability to control the forces pressing each individual substrate against the pad is limited by the floating nature of such a wafer head assembly, and therefore is a compromise between individual control and ease of controlling the general polishing attributes of the multiple substrates. Finally, if any one substrate develops a problem, such as if a substrate cracks, a broken piece of the substrate may come loose and destroy all of the other substrates being polished on the same pad.

Polishing throughput is yet further limited by the requirement that wafers be washed at the end of polishing and sometimes between stages of polishing. Although washing time has been limited in the past by simultaneously washing multiple wafer head, insofar as the washing requires additional machine time over that required for polishing, system throughput is adversely affected.

Additionally, when a polishing system is to be commercialized, it must be flexible and adaptable to a number of different polishing processes. Different integrated-circuit manufacturers prefer different polishing processes dependent on their overall chip design. Different layers to be planarized require distinctly different polishing processes, and the chip manufacturer may wish to use the same polishing system for two different polishing processes. Rather than designing a polishing system for each polishing process, it is much preferable that a single design be adaptable to the different processes with minimal changes of machinery.

Therefore, there is a need for a polishing apparatus which enables optimization of polishing throughput, quality, and flexibility.

SUMMARY OF THE INVENTION

The present invention provides methods and apparatus for polishing a semiconductor substrate.

One embodiment of the present invention provides an apparatus for processing substrates. The apparatus comprises a base, first and second processing stations disposed on the base, first and second pivot arms independently pivotable about a pivot point, a first carrier head mounted on the first pivot arm, wherein the first carrier head is configured to carry a substrate between the first and second processing stations, and a second carrier head on the second pivot arm, wherein the second carrier head is configured to carry a substrate between the first and second processing stations.

Another embodiment of the present invention provides an apparatus for polishing a semiconductor substrate. The apparatus comprises a base, a first load cup configured to receive a substrate and disposed on the base, first and second polishing stations disposed on the base, first and second pivot arms disposed on the base wherein the first and second pivot arms are independently pivotable about a first pivot point, a first polishing head mounted on the first pivot arm, wherein the first polishing head is configured to carry a substrate among the first load cup and the first and second polishing stations, and a second polishing head mounted on the second pivot arm, wherein the second polishing head is configured to carry a substrate among the first load cup and the first and second polishing stations.

Yet another embodiment of the present invention provides a method for polishing semiconductor substrates. The method comprises providing a first load cup, providing a first polishing station configured to perform a first polishing step, providing a second polishing station configured to perform a second polishing step, providing first and second pivot arms independently pivotable about a first pivot point and configured to carry substrates among the first load cup, the first and second polishing stations, performing the first polishing step to a first substrate by pivoting the first pivot arm over the first polishing station, and performing the second polishing step to the first substrate by pivoting the first pivot arm over the second polishing station while performing the first polishing step to a second substrate by pivoting the second pivot arm over the first polishing station.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

The present invention provides methods and apparatus for polishing semiconductor substrates in a high throughput and flexible manner.

Figure 1:
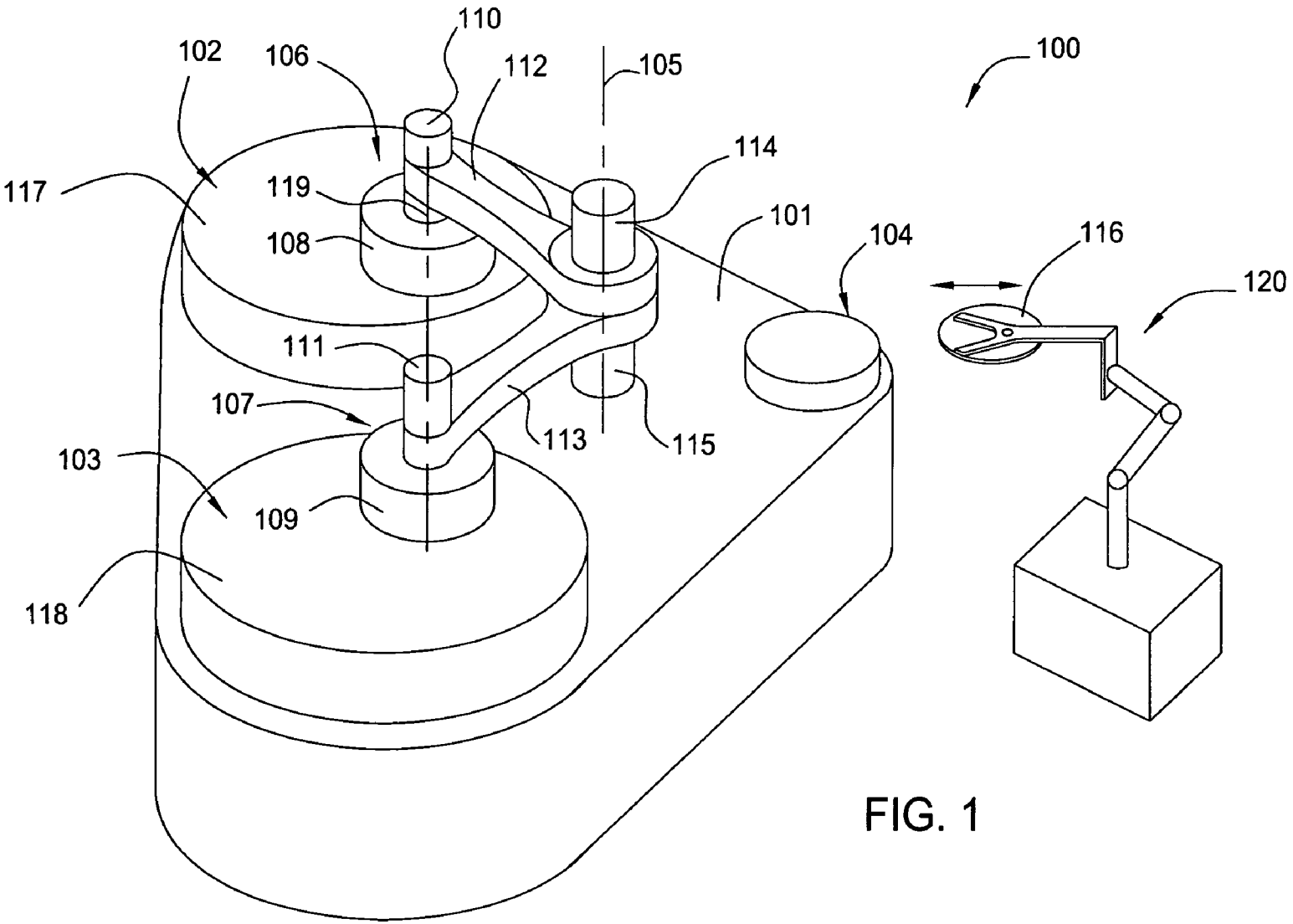
FIG. 1 illustrates a perspective view of a polishing system in accordance with one embodiment of the present invention.

FIG. 1 illustrates a perspective view of a polishing system 100 in accordance with one embodiment of the present invention. The polishing system 100 is configured to conduct CMP and/or ECMP on semiconductor substrates. The polishing system 100 generally comprises a base 101 that supports a first polishing station 102, a second polishing station 103 and a load cup assembly 104. A robot 120 may be used to drop off/pick up a substrate 116 to/from the load cup assembly 104. In one embodiment, the base 101 is designed to have an optimized footprint. In another embodiment, the base 101 has a rectangular shape configured for easy integration of two or more similar polishing systems (further description will be given in FIGS. 5-6). Each polishing station 102 or 103 includes a platen 117 or 118 on which a polishing pad may be placed.

The polishing system 100 further comprises a first wafer head system 106 and a second wafer head system 107. The first and second wafer head systems 106 and 107 are configured to operate independently from one another. Both of the wafer head systems 106 and 107 are independently pivotable about a pivot axis 105. The first wafer head system 106 comprises a pivot arm 112 having a pivot point on the pivot axis 105, a pivot motor 114 coupled to the pivot arm 112 along the pivot axis 105, and a wafer head 108 coupled on a distal end of the pivot arm 112. The wafer head 108 is further coupled to a head rotating motor 110 so that the wafer heat 108 rotates about its center. The wafer head 108 is configured to retain, transfer and rotate a substrate in a face down position so that the substrate may be polished in either the first polishing station 102 or the second polishing station 103. In one embodiment, the wafer head 108 is further configured to lower or raise a substrate retained therein so that a polishing or transferring procedure may be performed.

In one aspect, the pivot motor 114 rotates to pivot the pivot arm 112 about the pivot axis 105 so that the wafer head 108 moves among the first polishing station 102, the second polishing station 103 and the load cup assembly 104. In another aspect, the pivot motor 114 is also configured to oscillate the wafer head 108 during polishing process so that a substrate being processed moves back and forth across a diameter of a corresponding platen 117 or 118. In one embodiment, the pivot motor 114 is a direct drive motor.

The second wafer head system 107 is similar to the first wafer head assembly, comprising a pivot motor 115, a pivot arm 113, a wafer head 109, and a head rotating motor 111. The pivot motor 115 rotates the pivot arm 113 so that the wafer head 109 moves among the first and second polishing stations 102, 103 and the load cup 104. The pivot motor 115 also oscillates the wafer head 109 during polishing.

The pivot motors 114 and 115 are vertically disposed along the pivot axis 105 in a concentrical manner. The pivot arms 112 and 113 are also vertically disposed from one another. In one embodiment, the pivot motors 114, 115 and the pivot arms 112, 113 may be all coupled to a stationary shaft (not shown) fixed to the base 101 and coaxial with the pivot axis 105. In one embodiment, the first wafer head system 106 may comprise an extended shaft 119 so that the wafer head 108 has the same vertical level as of the wafer head 109. In one embodiment, the load cup assembly 104 is doubled as a wash station for washing the substrate and the wafer heads 108 and 109.

During process, the wafer head systems 106 and 107 can travel from one polishing station to another polishing station while transferring substrates or the load cup 104, therefore conducting a continuous two step polishing process without unloading/loading substrates between the two steps. Less wafer loading/unloading leads to increased throughput and improved reliability. Since both wafer head systems 106 and 107 have independent access to the load cup assembly 104, the polishing system 100 is also capable of conducting a batch process, wherein substrates are loaded into one wafer head system 106 or 107 from the load cup 104 and transferred to a polishing station 102 or 103, and then returned to the load cup 104. Additionally, at least two of the polishing systems 100 may be integrated to form a system with four or more polishing stations capable of conducting multi-step polishing process. Thus, the polishing system 100 increases throughput and flexibility at the same time.

Figure 2:
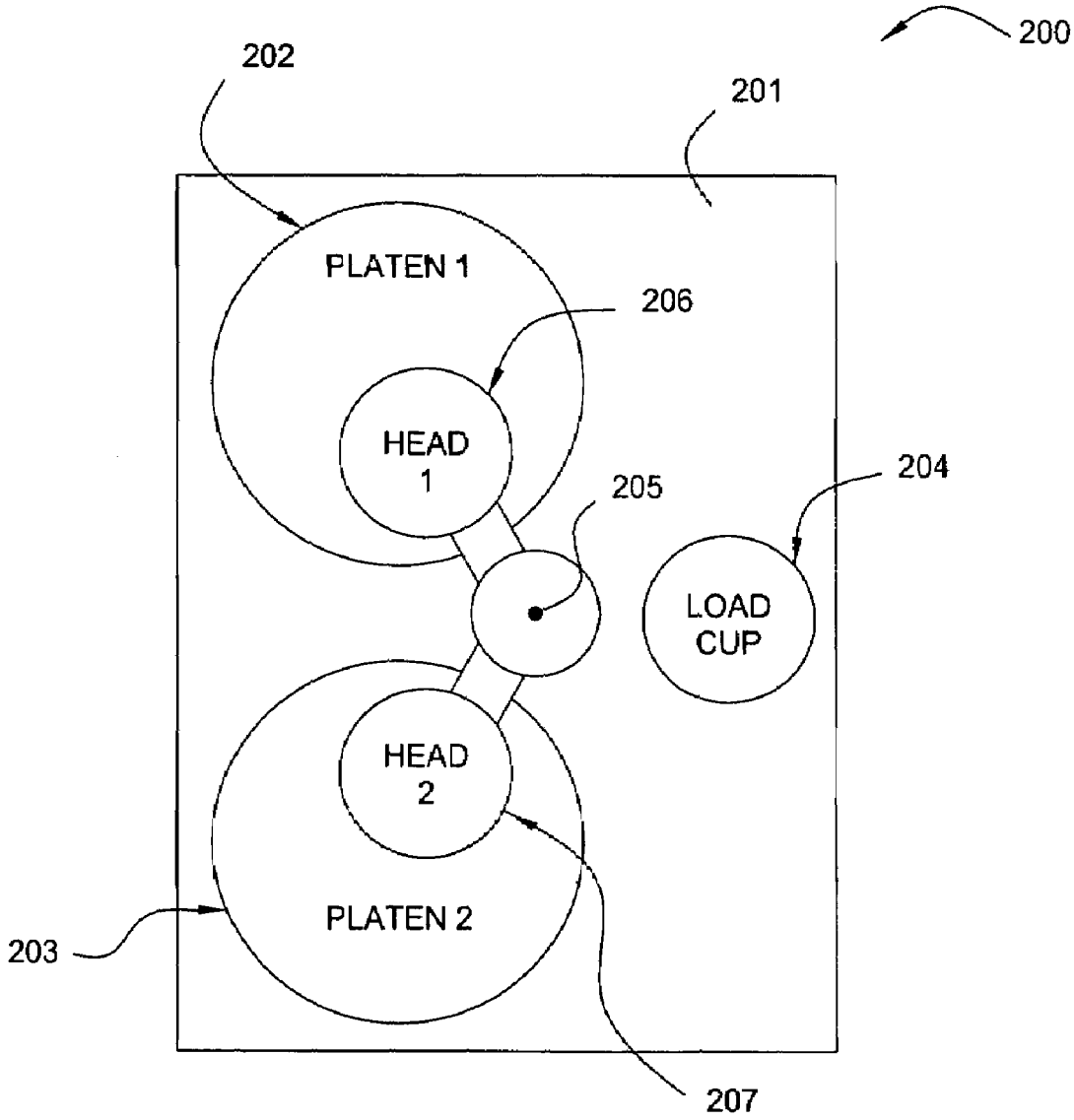
FIG. 2 illustrates a schematic top view of a polishing system in accordance with one embodiment of the present invention.

FIG. 2 illustrates a schematic top view of a polishing system 200 of the present invention. The polishing system 200 generally comprises a base 201 that supports polishing stations 202 and 203, and a load cup assembly 204. Platen 1 and platen 2 are included in the polishing station 202 and the polishing station 203 respectively. The polishing system 200 further comprises wafer head systems 206 and 207 having head 1 and head 2 respectively. The wafer head systems 206 and 207 are configured to operate independently from one another. Both of the wafer head systems 206 and 207 are independently pivotable about a pivoting axis 205, although each wafer head system is unable to pass through the other wafer head system. Head 1 and head 2 are configured to move among platen 1, platen 2 and the load cup. In one embodiment, the polishing system 200 may be constructed similar to the polishing system 100 of FIG. 1. However, detailed structures are omitted for the convenience of showing process sequences.

As discussed in the background, polishing parameters, including the relative speed between the substrate and the pad and the force pressing the substrate against the pad, affect the polishing rate, finish, and flatness. In semiconductor processing, a polishing result generally requires a polishing processes conducted in a sequence. Generally, there are three kinds of polishing sequences: the batch process, the in-line process, and the multi-step process.

The batch process polishes multiple wafers at respective polishing stations that have the same settings. The batch process improves throughput by using multiple polishing stations.

The in-line process divides an polishing operation into multiple steps at different polishing stations and the steps are substantially equivalent. One motivation for the in-line process arises from the need to condition a polishing pad before a complete polishing operation is finished. Further, the in-line process tends to average out irregularities of a particular polishing station.

The multi-step process divides a polishing operation into multiple and different steps, typically with gradated polishing, for example, a rough polishing step performed by a first polishing station, a fine polishing step performed by a second polishing station, and a buff step performed by a third polishing station. The multi-step process yields desired results. However, the multi-step process has inherent throughput problems because not all polishing steps require the same time.

Polishing systems of the present invention provide flexibility to perform different kind of polishing process as required by a particular process. High throughput may be achieved by proper sequencing.

Figure 3B:
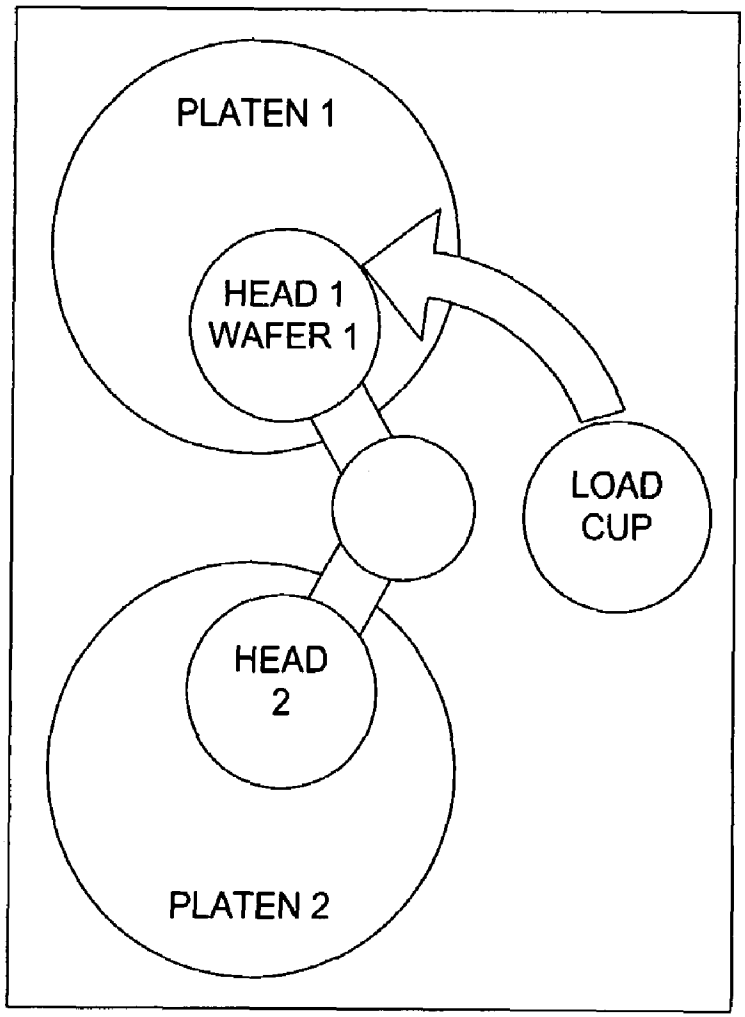
FIGS. 3A-3F illustrates an exemplary batch process using the polishing system of FIG. 2.
Figure 3A:
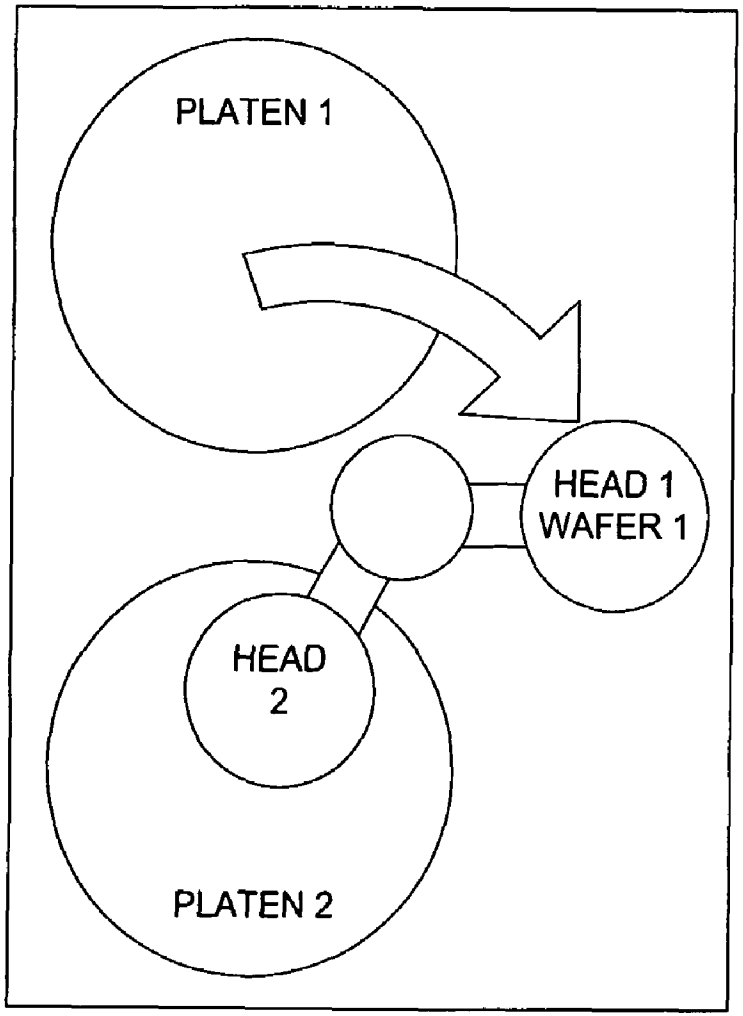
Figure 3D:
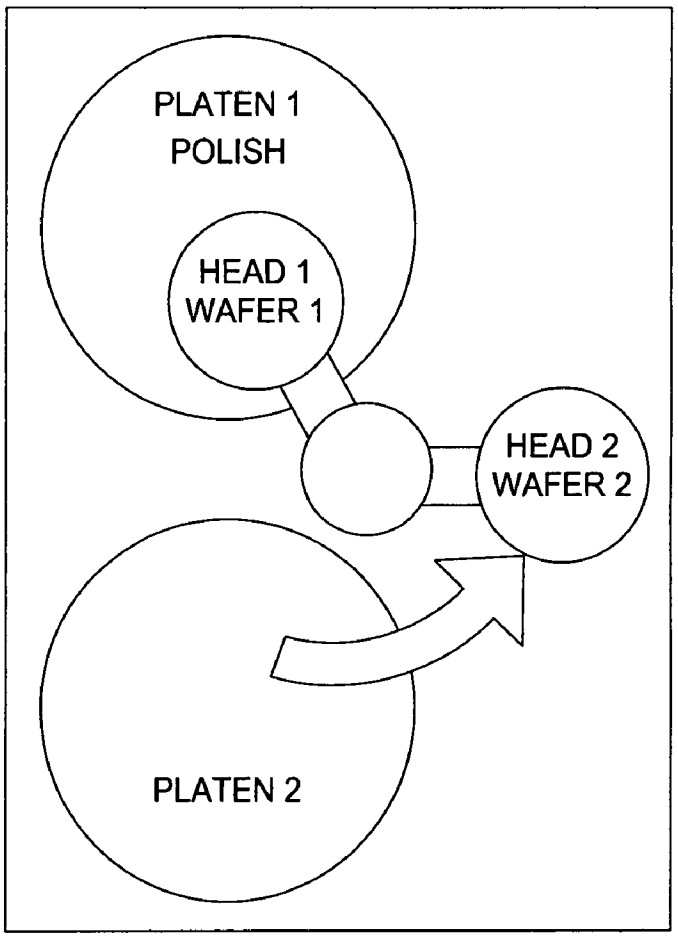
Figure 3C:
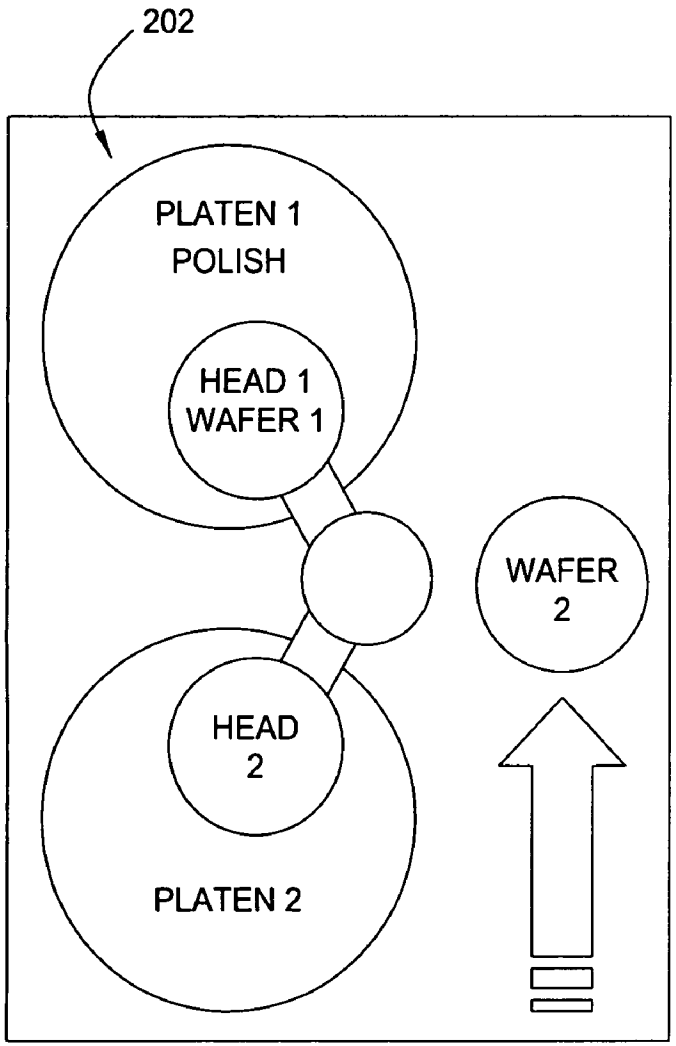
Figure 3F:
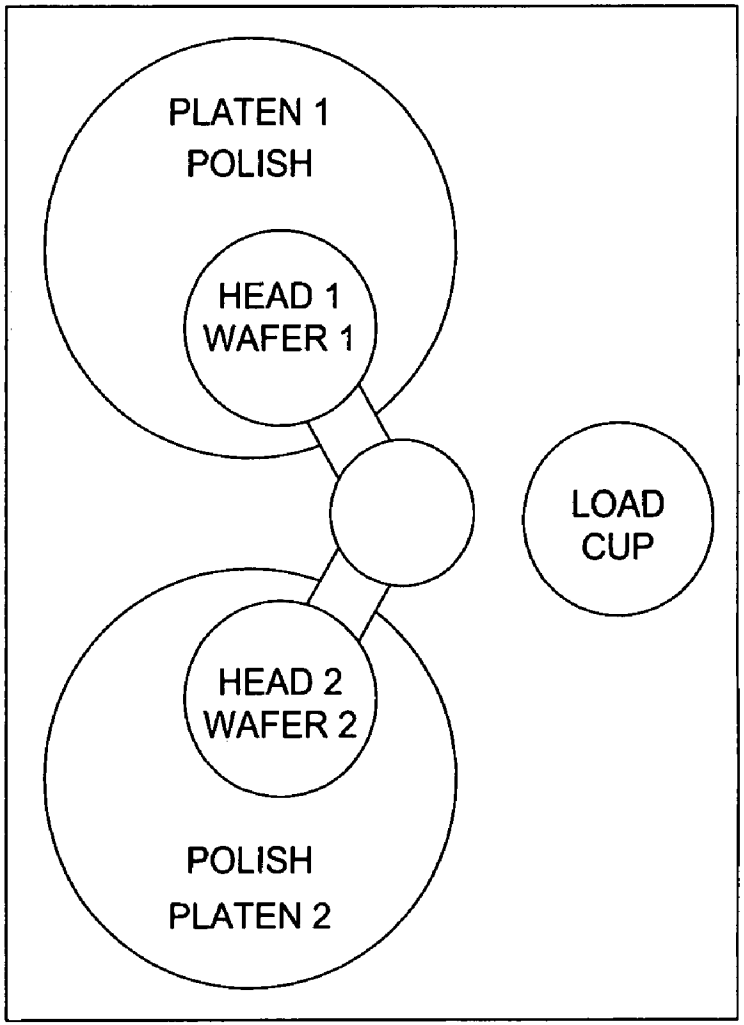
Figure 3E:
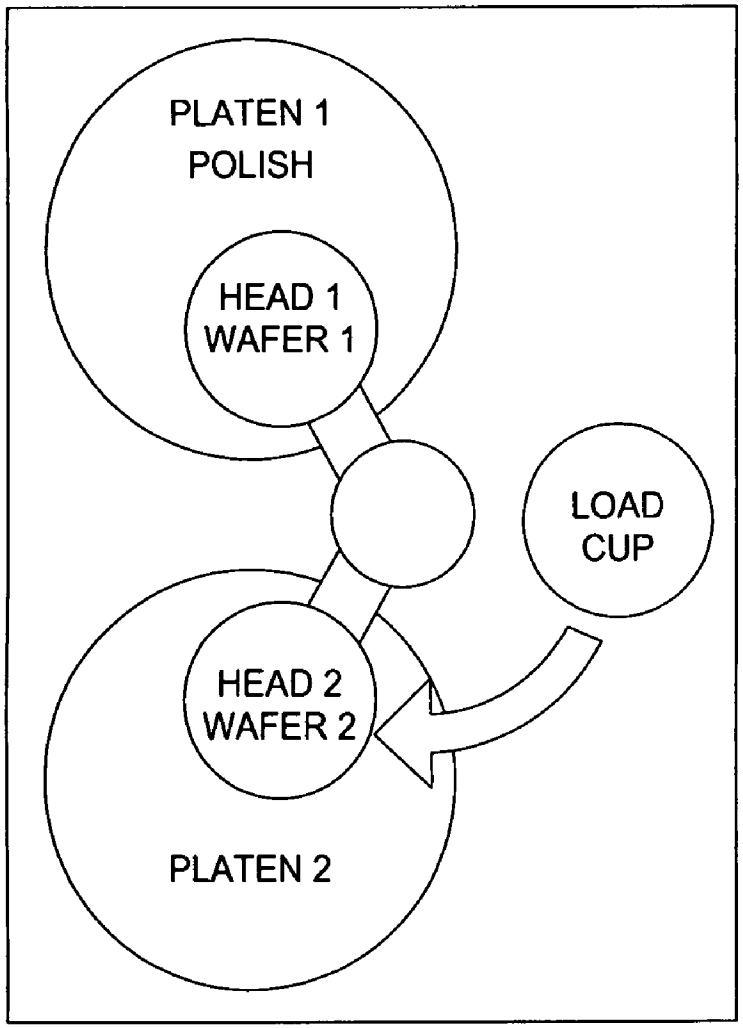

FIGS. 3A-3F illustrates an exemplary batch process using the polishing system 200. In one aspect, platen 1 and platen 2 are configured to perform the same polishing operation. In the beginning, the polishing system 200 is in an idle position with head 1 over platen 1 and head 2 over platen 2 as shown in FIG. 2. Shown in FIG. 3A, head 1 pivots from platen 1 to the load cup assembly 204 where wafer 1 has been dropped off by a robot. In FIG. 3B, head 1 pivots back to platen 1 after loading wafer 1 from the load cup assembly 204. In FIG. 3C, a polishing process starts in the polishing station 202. The operation of the polishing process generally includes lowing wafer 1 to contact platen 1, flowing in a slurry, rotating platen 1, rotating and oscillating head 1. Wafer 2 may be dropped off on the load cup assembly 204 after wafer 1 has been loaded in head 1. Head 2 remains idle over platen 2 during the steps shown in FIGS. 3A-3C. In FIG. 3D, head 2 pivots to the load cup assembly 204 while the polishing process continues for wafer 1 over platen 1. In FIG. 3E, head 2 pivots back to platen 2 after loading wafer 2, and polishing for wafer 1 continues. In FIG. 3F, a polishing process starts for wafer 2 while polishing for wafer 1 continues. Generally, it takes less time to pivot the heads, load/unload wafers, and pick up/drop off wafers. Therefore, the batch process may continue the steps without either head waiting for the load cup assembly 204.

Figure 4B:
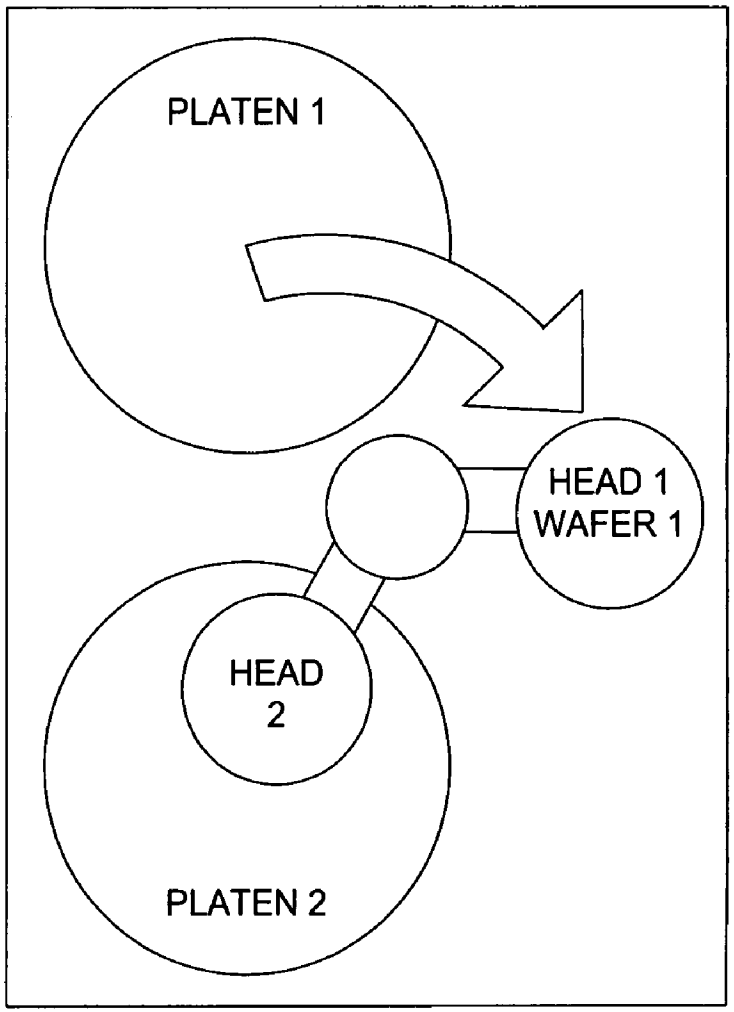
FIGS. 4A-4K illustrates an exemplary sequence of a polishing process using the polishing system of FIG. 2.
Figure 4A:
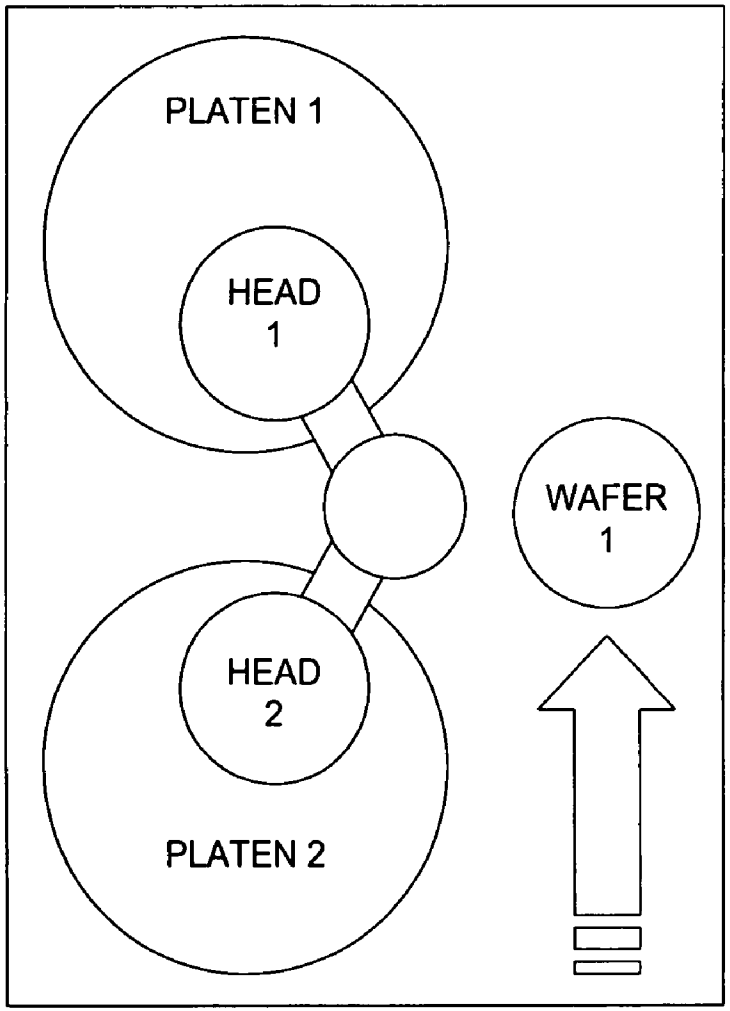
Figure 4D:
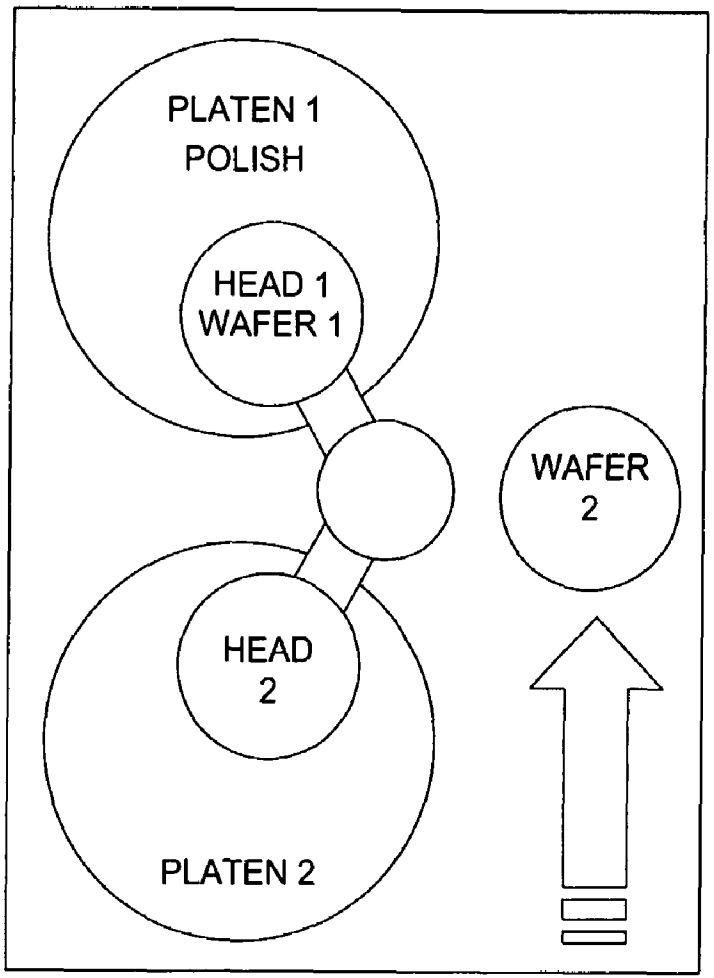
Figure 4C:
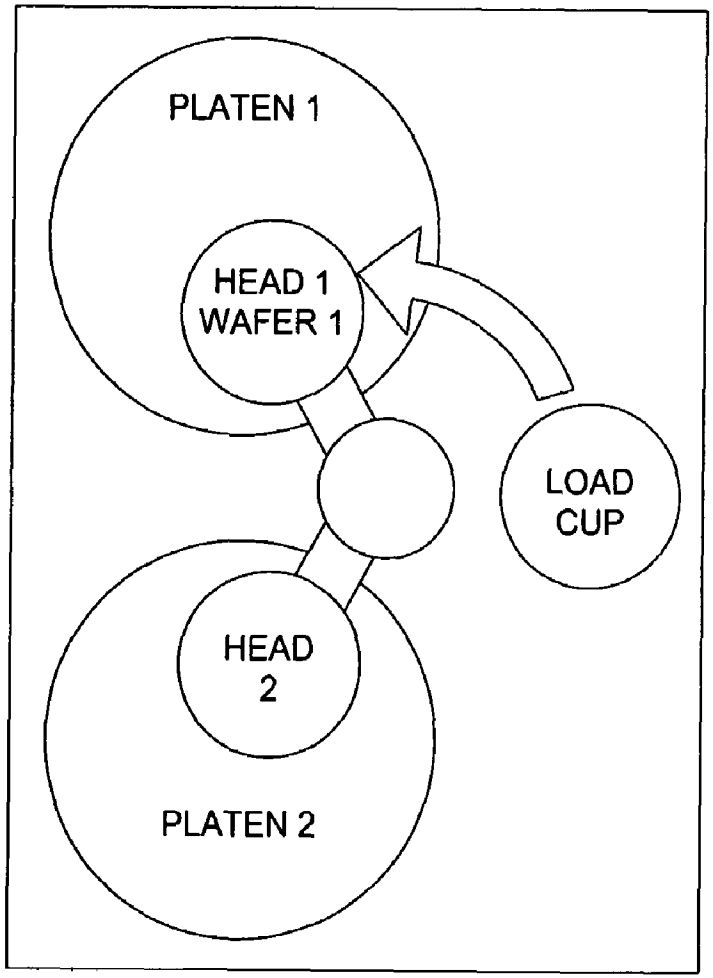
Figure 4F:
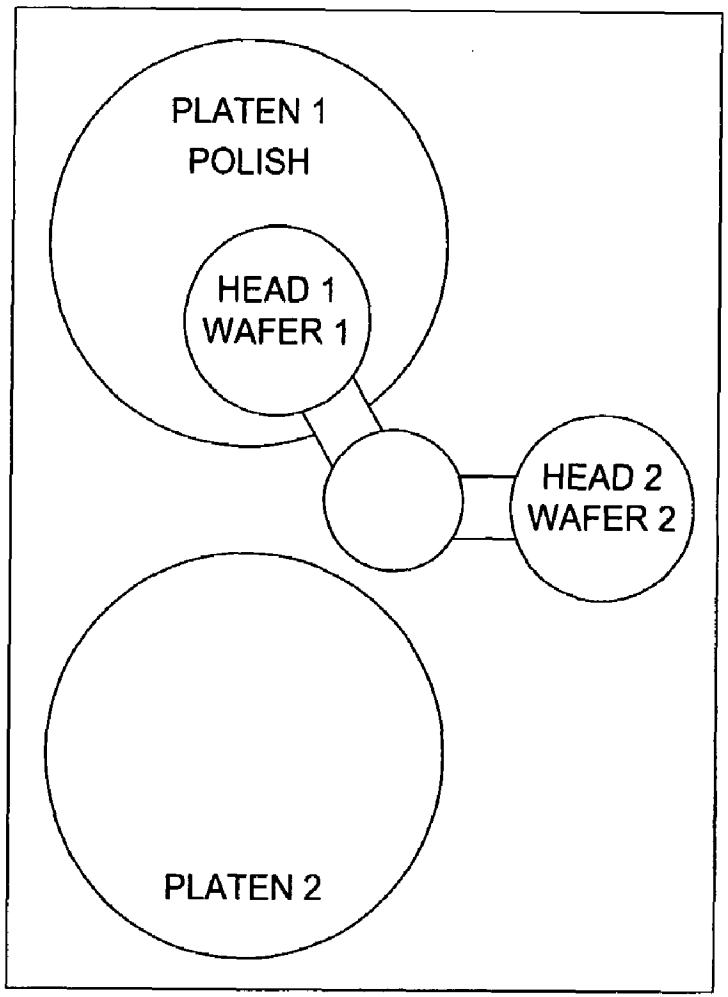
Figure 4E:
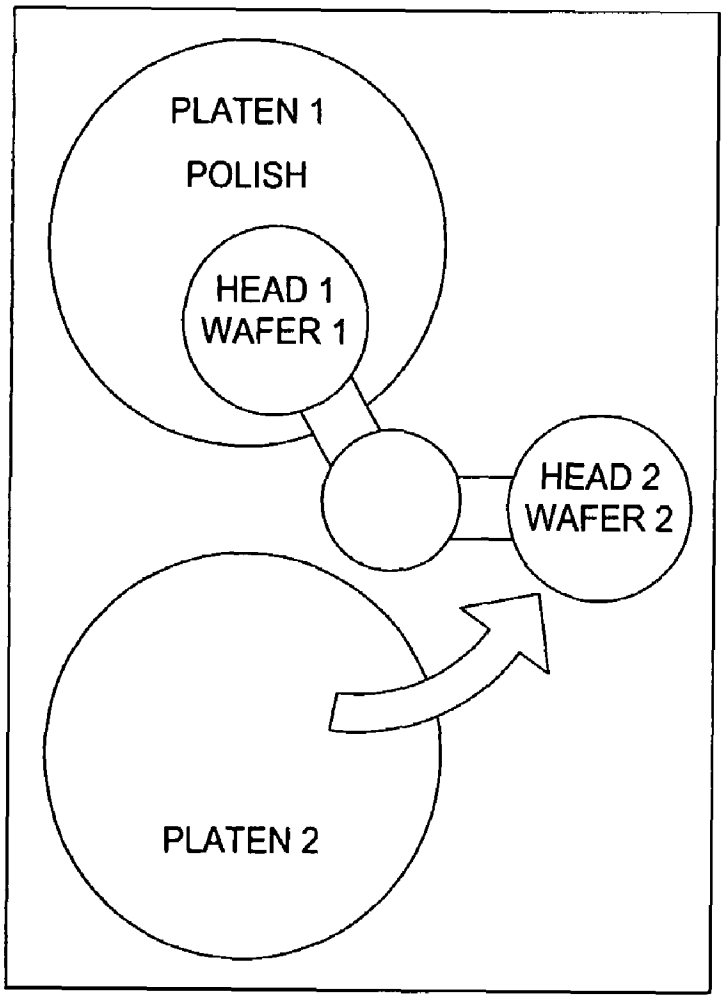
Figure 4H:
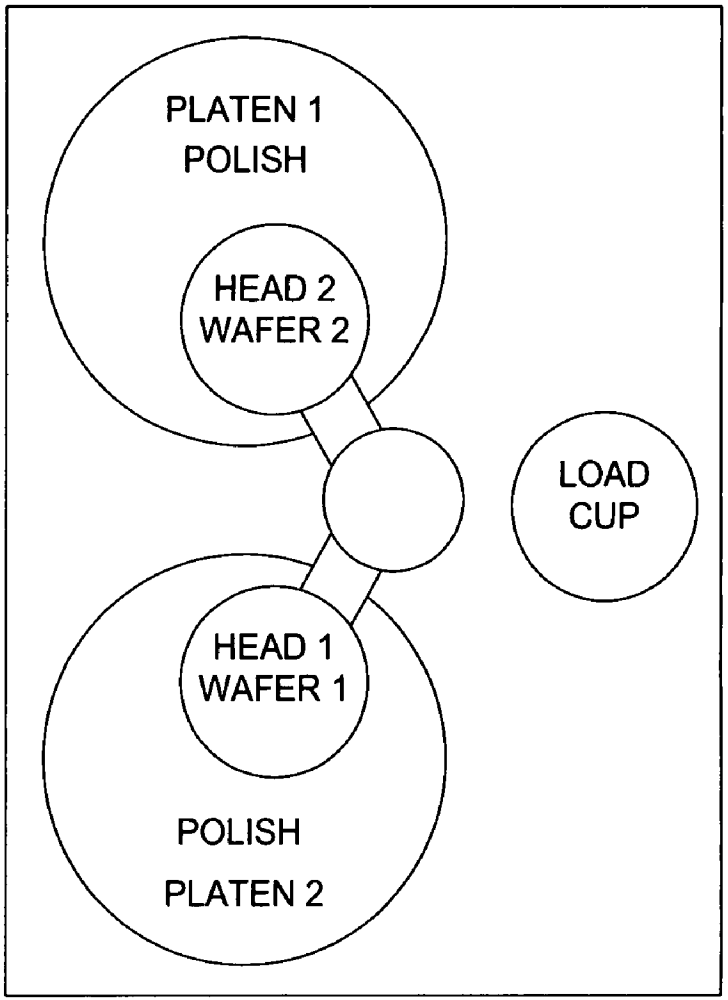
Figure 4G:
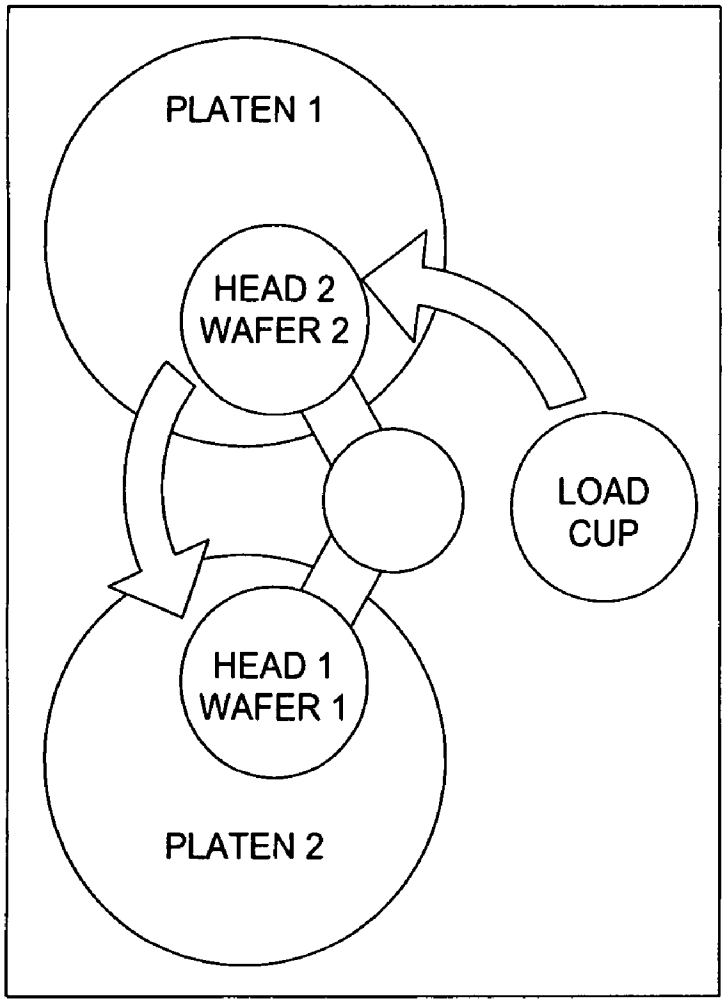
Figure 4J:
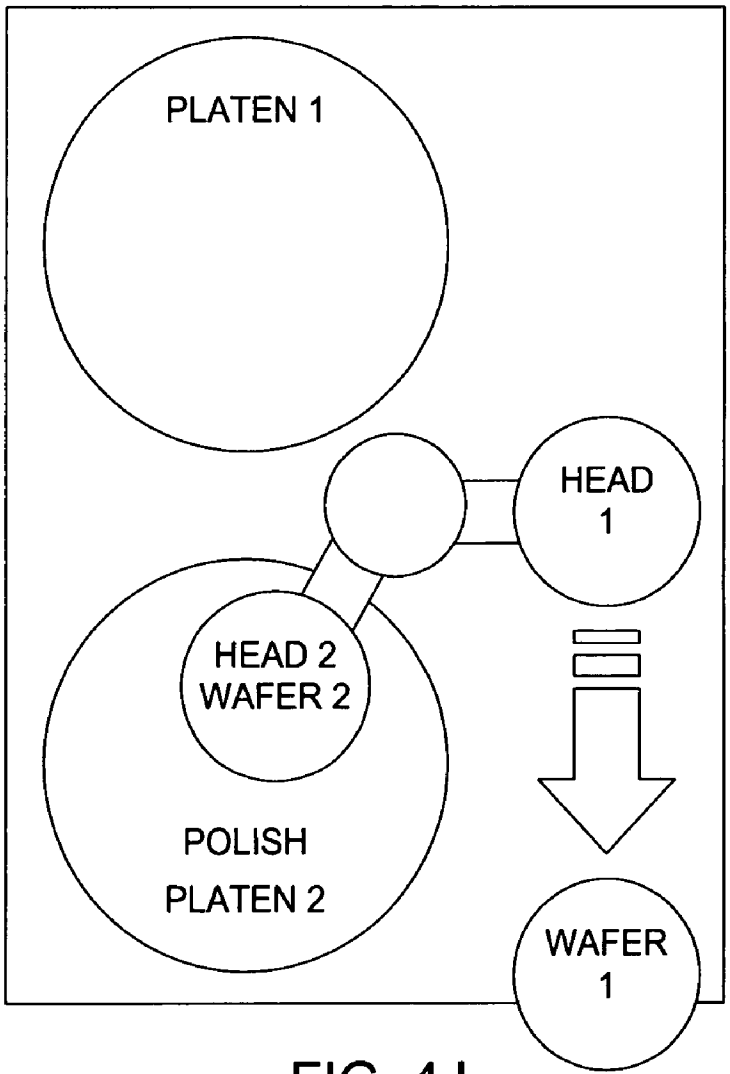
Figure 4I:
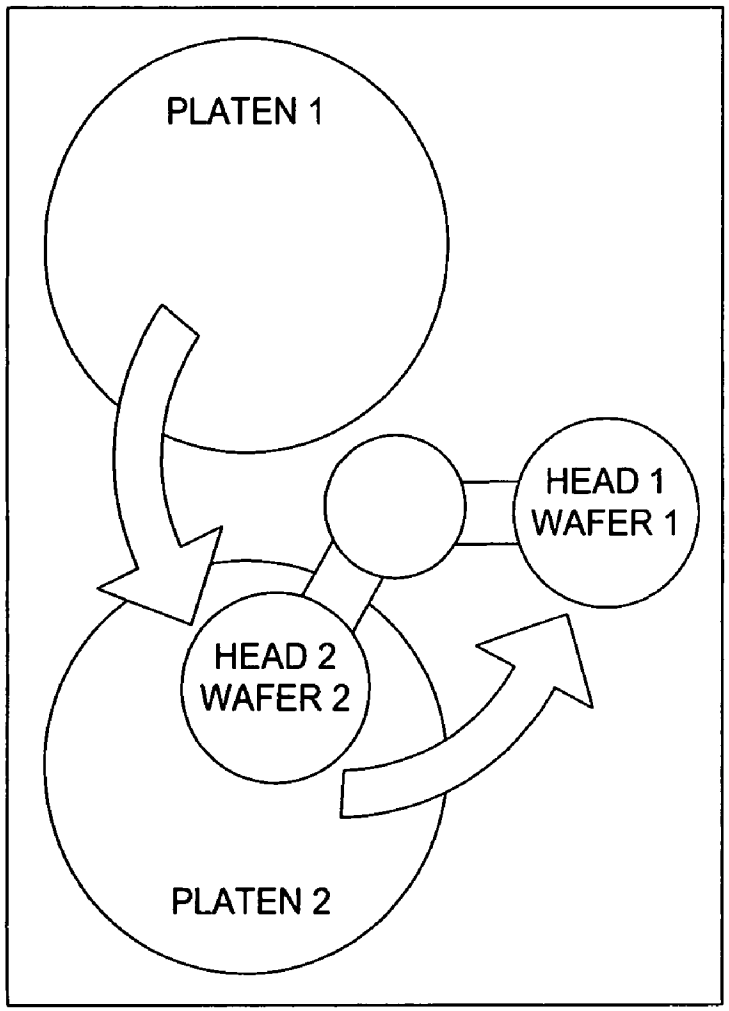
Figure 4K:
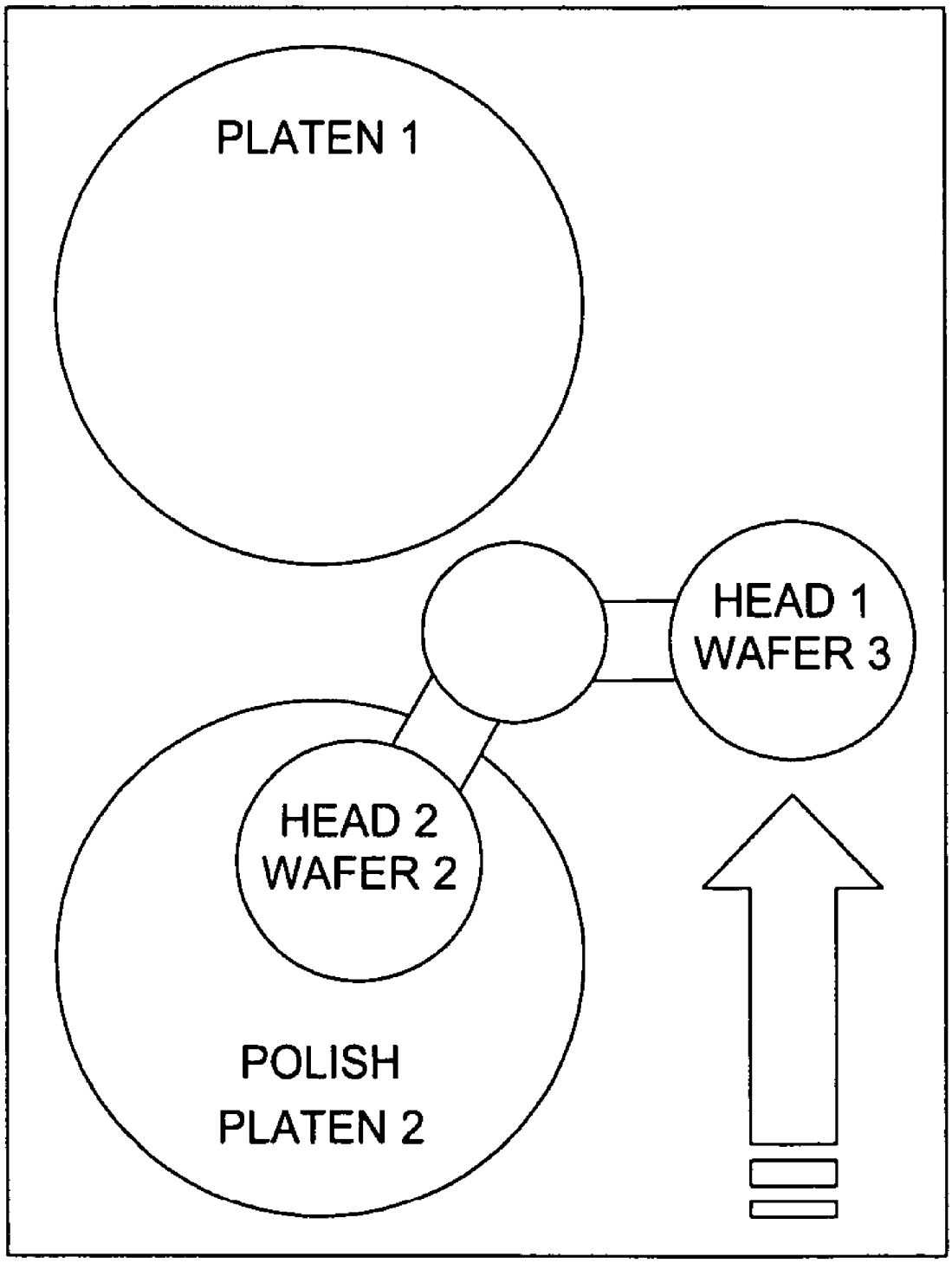

FIGS. 4A-4K illustrates an exemplary sequence of a two step process using the polishing system 200. In FIG. 4A, the polishing system 200 is in an initial position with head 1 over platen 1 and head 2 over platen 2. Platen 1 in the polishing station 202 is configured to perform step 1 of the two step process, while platen 2 in the polishing station 203 is configured to perform step 2 of the two step process. Wafer 1 is dropped off on the load cup assembly 204. In FIG. 4B, head 1 pivots from platen 1 to the load cup assembly 204, while head 2 remains over platen 2. In FIG. 4C, head 1 pivots back from the load cup assembly 204 to platen 1 after loading wafer 1 while head 2 remains over platen 2. In FIG. 4D, polishing step 1 is started for wafer 1 in the polishing station 202, wafer 2 is dropped off onto the load cup assembly 204, and head 2 remains over platen 2. In FIG. 4E, head 2 pivots from platen 2 to the load cup assembly 204 while polishing step 1 continues for wafer 1. FIG. 4F illustrates that head 2 with wafer 2 queues in the load cup assembly 204 while polishing step 1 for wafer 1 is completing. In FIG. 4G, head 1 with wafer 1 pivots from platen 1 to platen 2 after polishing step 1 for wafer 1 has completed, and head 2 with wafer 2 pivots from the load cup to platen 1. In FIG. 4H, wafer 1 retained by head 1 is polished by platen 2 for polishing step 2 while wafer 2 retained by head 2 is polished by platen 1 for polishing step 1. In FIG. 4I, head 1 with wafer 1 pivots from platen 2 to the load cup after polishing step 2 has completed for wafer 1, and head 2 with wafer 2 pivots from platen 1 to platen 2 after finishing polishing step 1 for wafer 2. In FIG. 4J, polishing step 2 for wafer 2 started in platen 2. In the load cup assembly 204, head 1 unload wafer 1 which is then picked up by a robot. In FIG. 4K, polishing step 2 for wafer 2 continues in platen 2, while wafer 3 is dropped off on the load cup and then loaded in head 1.

In the 2 step process shown in FIGS. 4A-4K, each wafer being processed is polished by two processes in two polishing station, yet only requires loading/unloading once. Therefore, the polishing system 200 reduces loading/unloading in a multi-step process, hence increases throughput and reliability.

Figure 5:
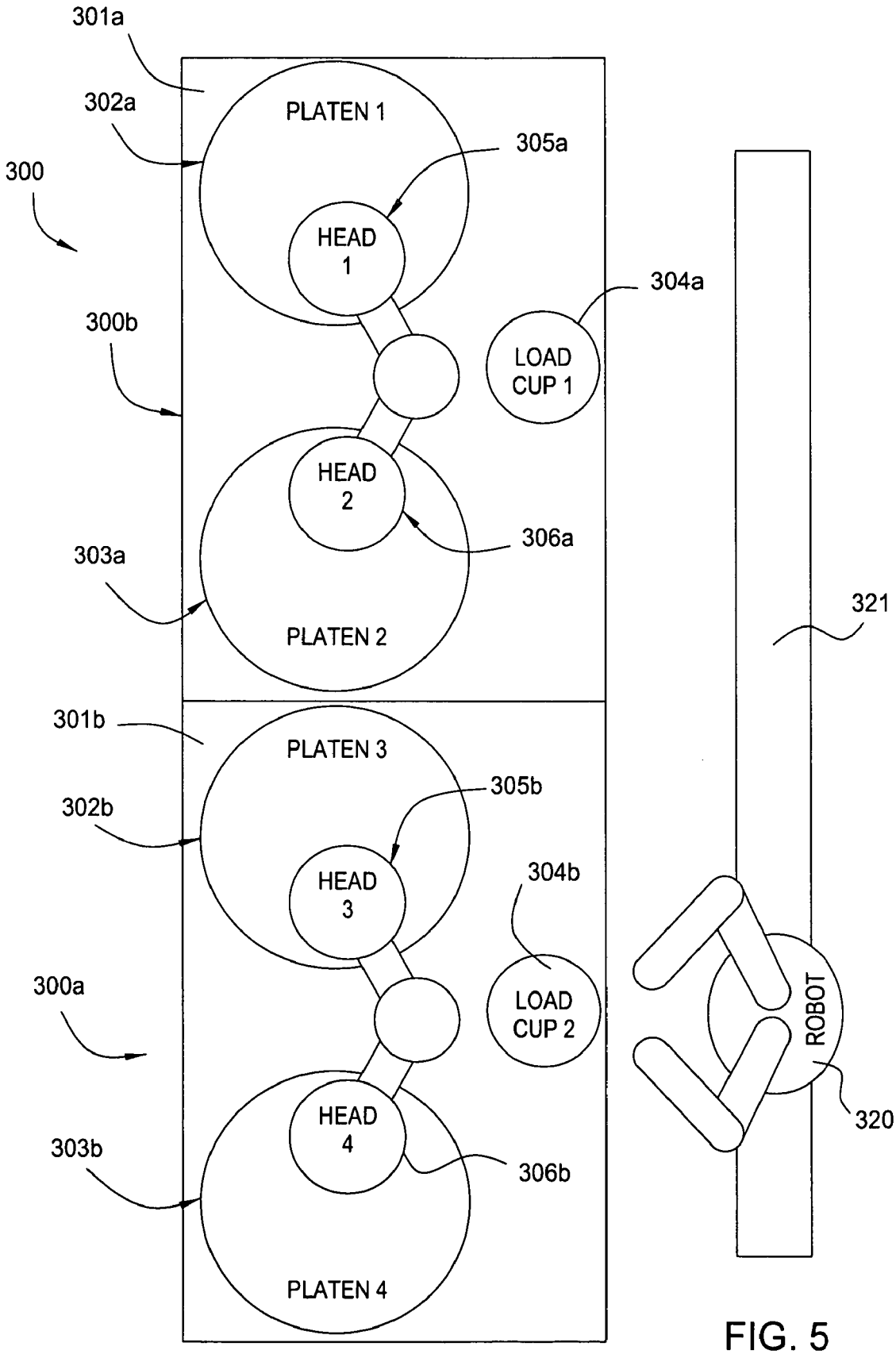
FIG. 5 illustrates a schematic top view of an integrated polishing system in accordance with one embodiment of the present invention.

FIG. 5 illustrates a schematic top view of an integrated polishing system 300 in accordance with one embodiment of the present invention. The integrated polishing system 300 comprises two polishing system modules 300*a* and 300*b*, each having two polishing stations 302*a*/303*a* and 302*b*/303*b* respectively. The polishing system modules 300*a* and 300*b* are positioned side by side so that the polishing stations 302*a*, 303*a*, 302*b* and 303*b* are in a linear arrangement. Similar to the polishing systems 100 and 200 in FIGS. 1 and 2, each polishing module 300*a*/300*b* comprises independently pivotable wafer head assemblies 305*a*, 306*a*/306*b*, and a load cup 304*a*/304*b*. A robot 320 facing the load cups 304*a* and 304*b* is movable along a track 321 and is configured to pick-up/drop off wafers from/onto the load cups 304*a*, 304*b*. The robot 320 has easy access to the load cups 304*a* and 304*b* and is capable of transferring wafers between the load cups 304*a* and 304*b* by moving along the track 321. The integrated polishing system 300 is configured to perform the batch process, the multi-step process and the in-line process. Additional polishing modules, and robots may be added to the system to performing complicated polishing sequences.

Figure 6:
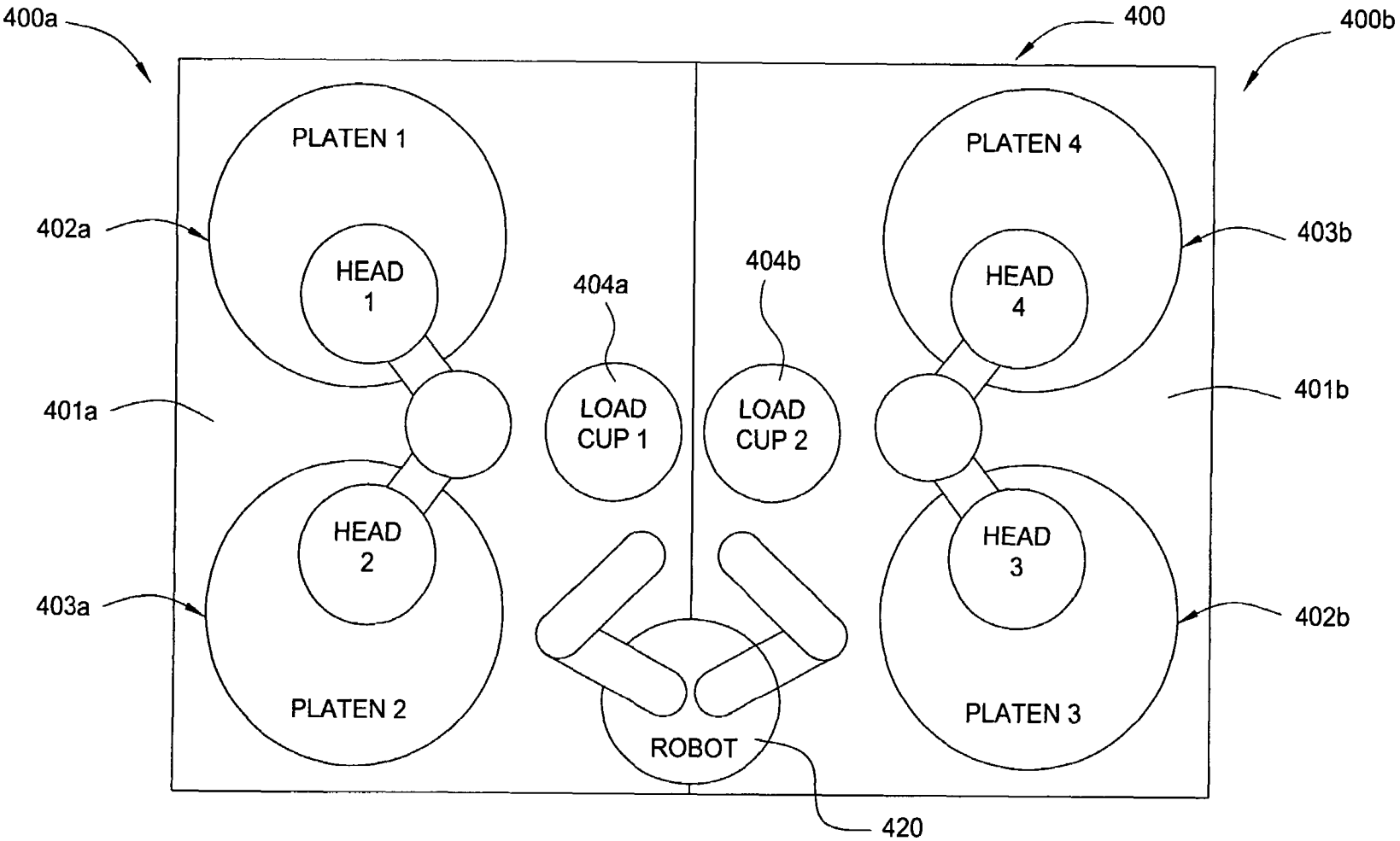
FIG. 6 illustrates a schematic top view of an integrated polishing system in accordance with one embodiment of the present invention.

FIG. 6 illustrates a schematic top view of an integrated polishing system 400 in accordance with one embodiment of the present invention. The integrated polishing system 400 comprises two polishing system modules 400*a* and 400*b*, each having two polishing stations 402*a*/403*a* and 402*b*/403*b* respectively. The polishing system modules 400*a* and 400*b* are positioned face to face so that each polishing station 302*a*, 303*a*, 302*b* and 303*b* occupies a corner. Similar to the polishing systems 100 and 200 in FIGS. 1 and 2, each polishing module 400*a*/400*b* comprises independently pivotable wafer head assemblies 405*a*, 406*a*/405*b*, 406*b*, and a load cup 404*a*/404*b*. The load cups 404*a* and 404*b* are positioned next to each other. A robot 420 positioned between the load cups 404*a* and 404*b* is configured to pick-up/drop off wafers from/onto the load cups 404*a*, 404*b*. The robot 420 has easy access to the load cups 404*a* and 404*b* and is capable of transferring wafers between the load cups 404*a* and 404*b* without a tracking move, therefore quickly. The integrated polishing system 400 is configured to perform the batch process, the multi-step process and the in-line process.

Integrated polishing systems, such as the integrated polishing systems 300 and 400, provide increased flexibility and are suitable for performing the batch process with large batch number, the multi-step process with more than 2 steps. For the multi-step process where one process step is longer than others, a build-in batch process may be used for the long step to improve throughput.

Figure 7A:
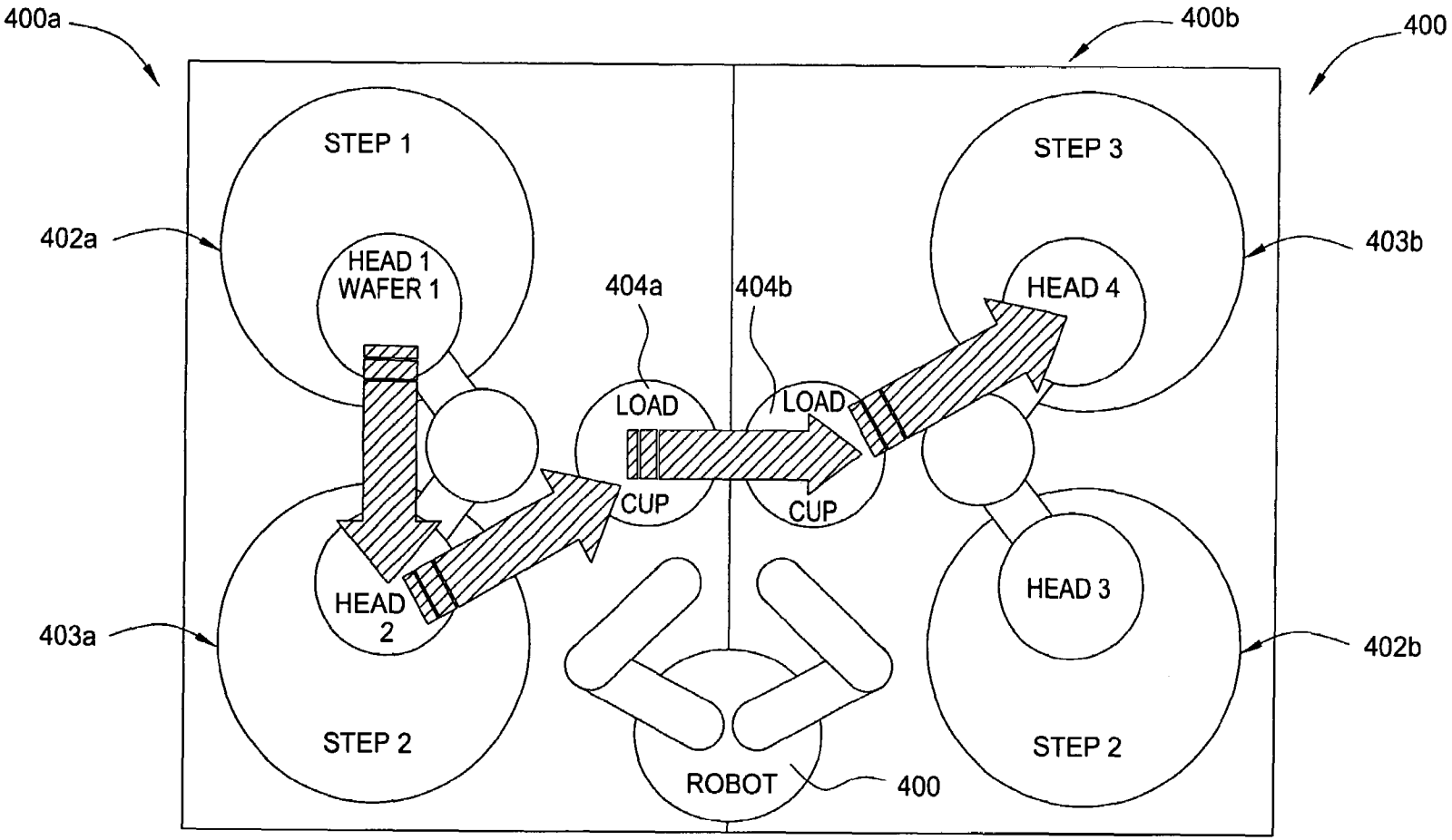
FIGS. 7A-7B illustrates an exemplary method of performing a polishing process using the integrated polishing system of FIG. 6.
Figure 7B:
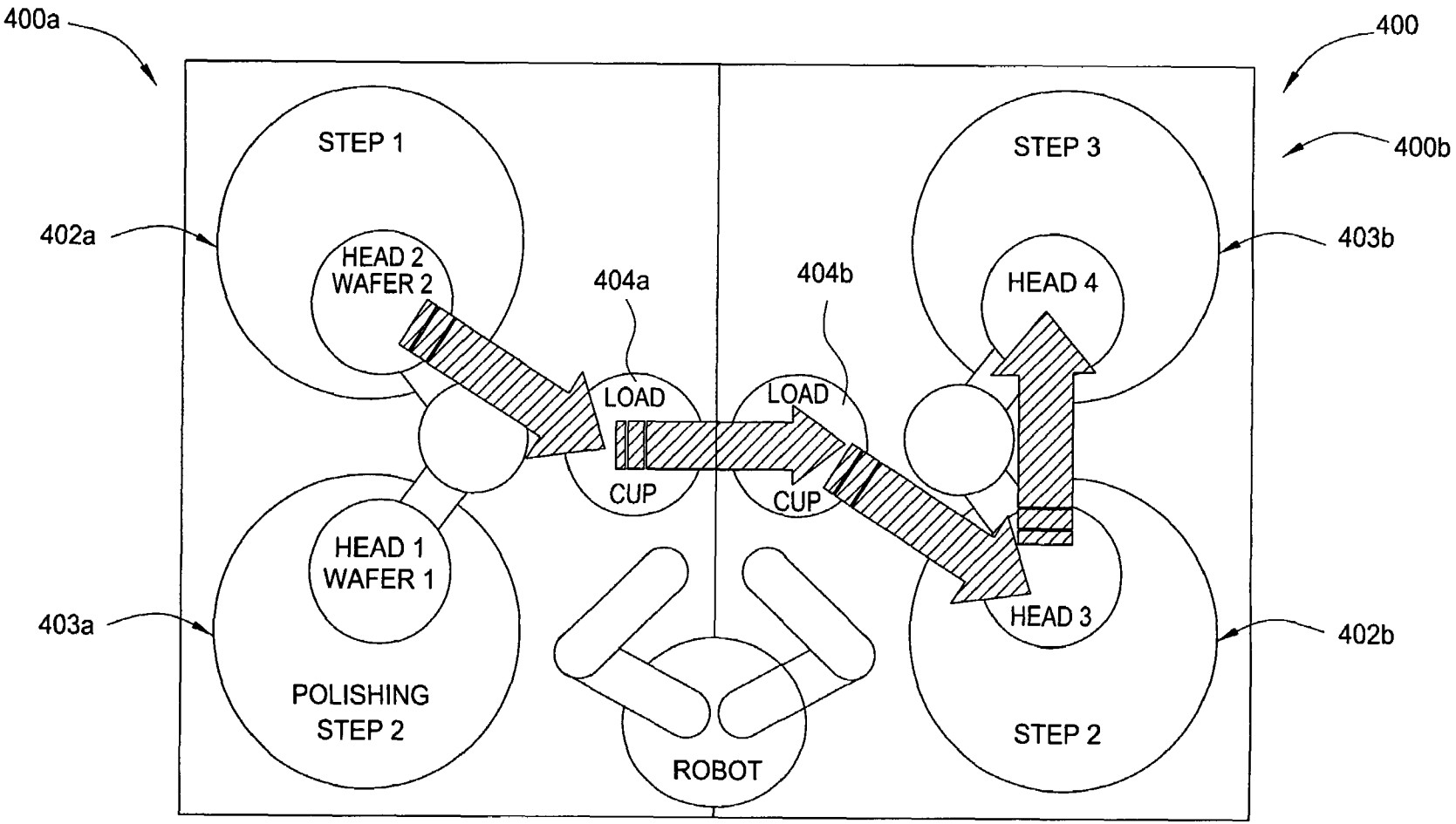

FIGS. 7A-7B illustrates an exemplary method of performing a three step process, in which step 2 is much longer than steps 1 and 3, using the integrated polishing system 400. As illustrated in FIG. 7A, the polishing station 402*a* is dedicated for polishing step 1; the polishing station 403*b* is dedicated for polishing step 3; and polishing stations 403*a* and 402*b* are both dedicated to the long polishing step 2. FIG. 7A shows a path for one half of the wafers, for example the odd numbered wafers in the queue. Wafer 1 is first loaded into head 1. Polishing step 1 is performed to wafer 1 in the polishing station 402*a*. Upon finishing polishing step 1, head 1 with wafer 1 pivots from the polishing station 402*a* to the polishing station 403*a* where polishing step 2 is performed. Upon finishing polishing step 2, wafer 1 is unloaded onto the load cup 404*a*. The robot 420 picks up wafer 1 from the load cup 404*a* and drop it off on the load cup 404*b*, where wafer 1 may be loaded onto head 4. Head 4 with wafer 1 then pivots to the polishing station 403*b* where polishing step 3 is performed to wafer 1.

FIG. 4B illustrates a path for another half of the wafers being polished, for example the even numbered wafers in the queue. As shown in FIG. 4B, after wafer 1 retained by head 1 starts polishing step 2 in the polishing station 403*a*, wafer 2 is loaded in head 2 which pivots to the polishing station 402*a* and conducts polishing step 1 on wafer 2. Since polishing step 2 is much longer than polishing step 1, wafer 2 finishes polishing step 1 before wafer 1 finishes polishing step 2. Instead of waiting for the polishing station 403*a* to be vacant, wafer 2 is unloaded onto the load cup 404*a* and then transferred to the load cup 404*b*, where head 3 pivots in and loads up wafer 2. After loading wafer 2, head 3 pivots to the polishing station 402*a*, which is also dedicated to performing polishing step 2. While wafer 2 stays in the polishing station 402*b* for polishing step 2, wafer 1 will finish polishing step 2 in the polishing station 403*a*, move from the load cup 404*a* to the load cup 404*b*, then be loaded into head 4 for polishing step 3 in the polishing station 403*b*, as shown in FIG. 4A. When wafer 1 finishes polishing step 3, and wafer 2 finishes polishing step 2, head 3 with wafer 2 will pivot to the polishing station 403*b* to perform polishing step 3 on wafer 2.

In the sequence described in FIGS. 7A-7B, to finish the three step polishing, each wafer is loaded/unloaded twice by polishing heads, and transferred once from one load cup to another load cup, and the long polishing step is relieved from being the bottle neck of the process. A three step process with long step 1 or long step 2 can be performed by a similar manner.

It is obvious to person skilled in the art, integrated polishing systems, such as the polishing systems 300 and 400, are capable of many other sequences, for example a four time batch process (4×1), and a four step polishing (1×4).

Figure 8:
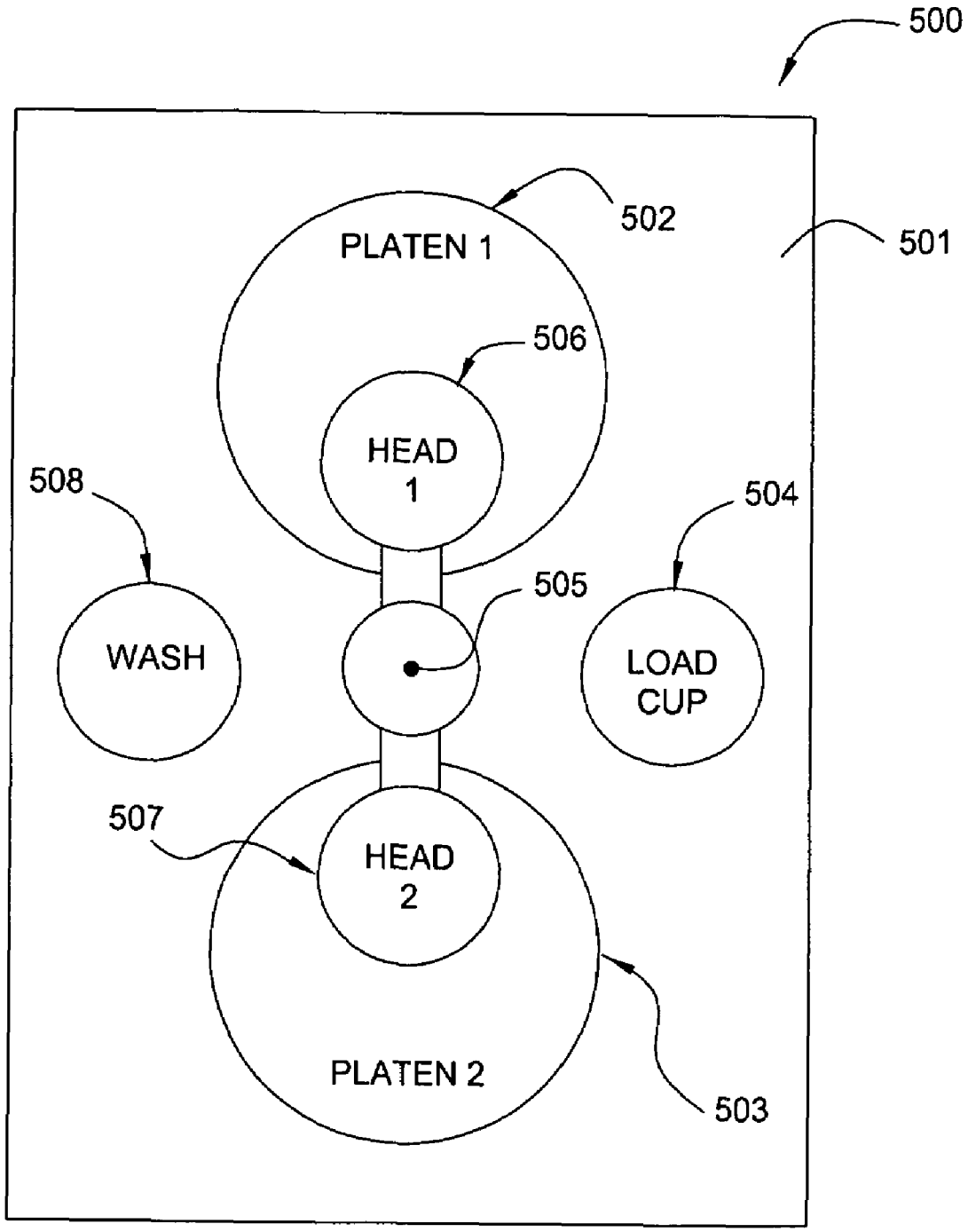
FIG. 8 illustrates a schematic top view of a polishing system in accordance with the present invention.

FIG. 8 illustrates a schematic view of a polishing system 500 in accordance with the present invention. The polishing system 500 generally comprises a base 501 that supports polishing stations 502 and 503, a wash station 508, and a load cup assembly 504. The polishing system 500 further comprises wafer head systems 506 and 507 having head 1 and head 2 respectively. The wafer head systems 506 and 507 are configured to operate independently from one another. Both of the wafer head systems 506 and 507 are independently pivotable about a pivoting axis 505. In one embodiment, the polishing stations 502/503, the wash station 508 and the load cup assembly 504 form a cross which is centered near the pivoting axis 505. Head 1 and head 2 are configured to move among the polishing station 502, the wash station 508, the polishing station 503 and the load cup assembly 504. The wafer head systems 506/507 and the wafers being processed may be washed in the wash station after a polishing process, or in the way of moving from one polishing station to another. Similar to the polishing systems 100 and 200, the polishing 500 may be used alone or serve as a module in an integrated polishing system.

Figure 9:
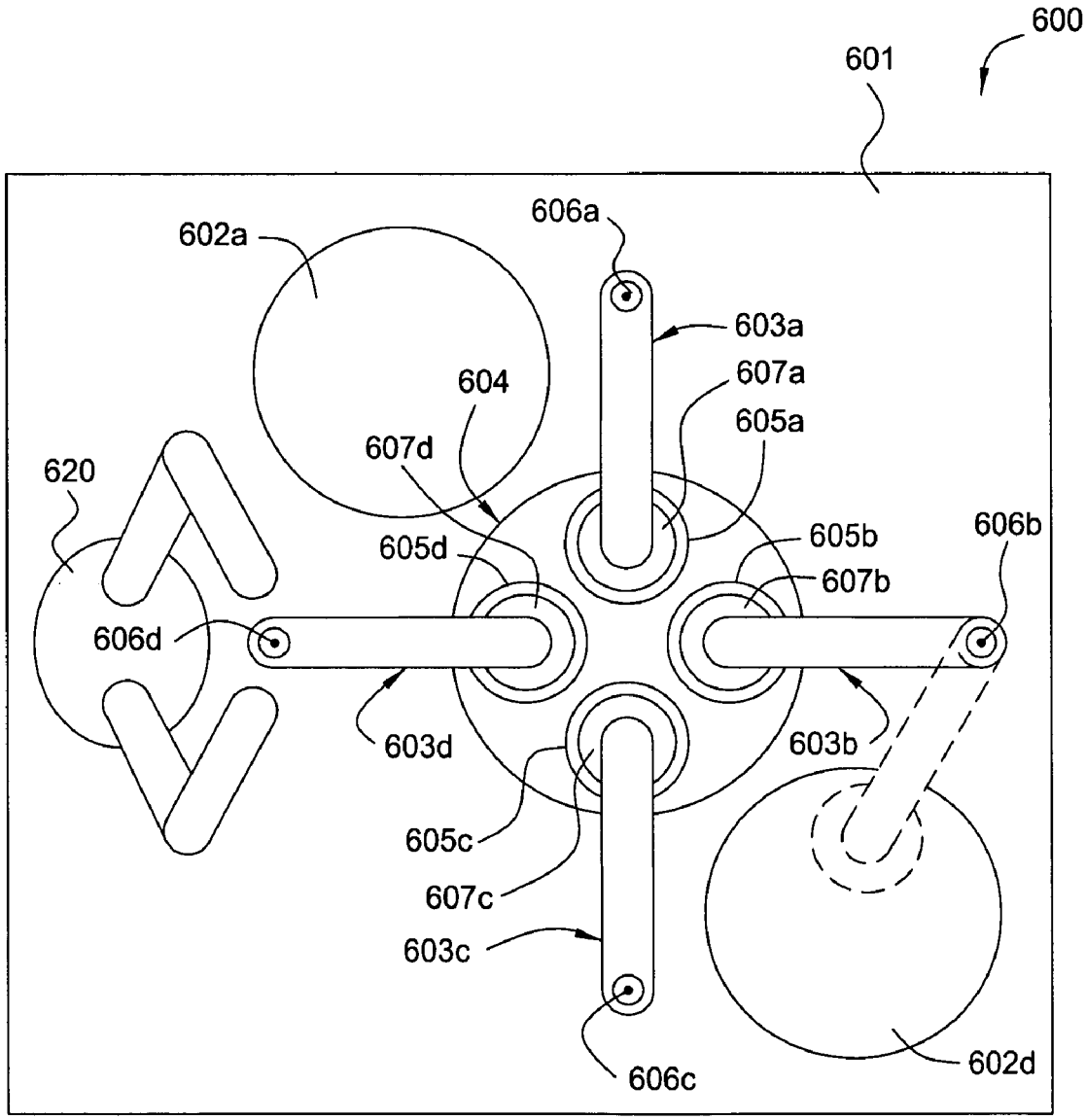
FIG. 9 illustrates a schematic top view of a polishing system in accordance with the present invention.

FIG. 9 illustrates a schematic top view of a polishing system 600 in accordance with one embodiment of the present invention. The polishing system 600 generally comprises a base 601 that supports polishing stations 602*a* and 602*b*. In one embodiment, the base 601 has a rectangular shape and the polishing stations 602*a* and 602*b* are disposed diagonally across the base 601. The polishing system 600 further comprises a load cup carousel 604 generally disposed near the center of the base 601. The load cup carousel 604 is rotatable about its center so that four load cups 605*a*-605*d* disposed on the load cup carousel 604 rotates and exchangeable. The polishing system 600 further comprises four independent wafer head systems 603*a*-603*d*. Each of the wafer head systems 603*a*-603*d* is pivotable about a pivot point 606*a*-606*d* so that a wafer head 607*a*-607*d* moves between a polishing station and the load cups. The wafer heads 607*a* and 607*d* have access to the polishing station 602*a* while the wafer heads 607*b* and 607*c* have access to the polishing station 602*b*. A robot 620 may be used to pick up and drop off a wafer from the most accessible load cups.

During process, the robot 620 drops off a wafer on one of the load cups 605*a*-605*d*. The load cup carousel 604 then rotates so that the wafer on the load cup is accessible to the intended wafer head, which then loads up the wafer, pivots towards the corresponding polishing station and conduct a polishing process. The load cup carousel 604 eliminates wafer transferring from one load cup to another, hence prevents cross contamination due to wafer exchange among the load cups. Additionally, the wafer heads may be washed in the load cups while not polishing. The polishing system 600 is particularly effective for a short polishing process, for example between about 30-60 seconds.

Figure 10:
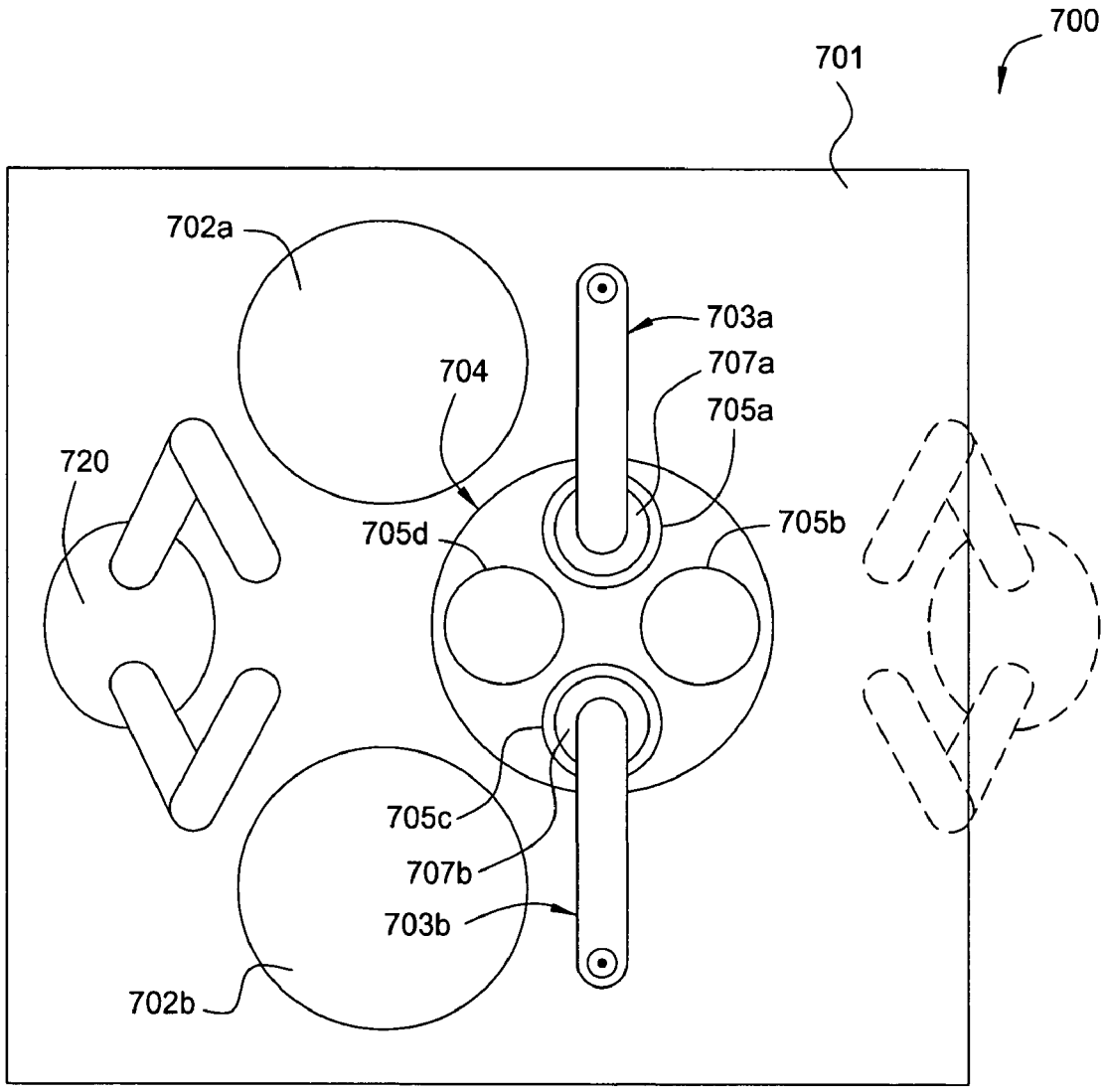
FIG. 10 illustrates a schematic top view of a polishing system in accordance with the present invention.

FIG. 10 illustrates a schematic top view of a polishing system 700 in accordance with one embodiment of the present invention. The polishing system 700 generally comprises a base 701 that supports polishing stations 702*a* and 702*b*, which are disposed on one side of the base 701. The polishing system 700 further comprises a load cup carousel 704 generally disposed on an opposite side of the base 701 and between the polishing stations 702*a* and 702*b*. The load cup carousel 704 is rotatable about its center so that four load cups 705*a*-705*d* disposed on the load cup carousel 704 rotates and exchangeable. The polishing system 700 further comprises two independent wafer head systems 703*a* and 703*d*. Each of the wafer head systems 703*a* and 703*b* is pivotable about a pivot point 706*a*/706*b* so that a wafer head 707*a*/707*b* moves between a polishing station and the load cups. The wafer heads 707*a* and 707*b* have access to the polishing stations 702*a* and 702*b* respectively. A robot 720 may be used to pick up and drop off a wafer from the most accessible load cups 705*a*-705*d*.

During process, the robot 720 drops off a wafer on one of the load cups 705*a*-705*d*. The load cup carousel 704 then rotate so that the wafer on the load cup is accessible to the intended wafer head, which then loads up the wafer, pivots towards the corresponding polishing station and conduct a polishing process. The polishing system 700 prevents cross contamination from wafer exchanging also provides easy access for the robot 720 to the load cup carousel 704.

Figure 11:
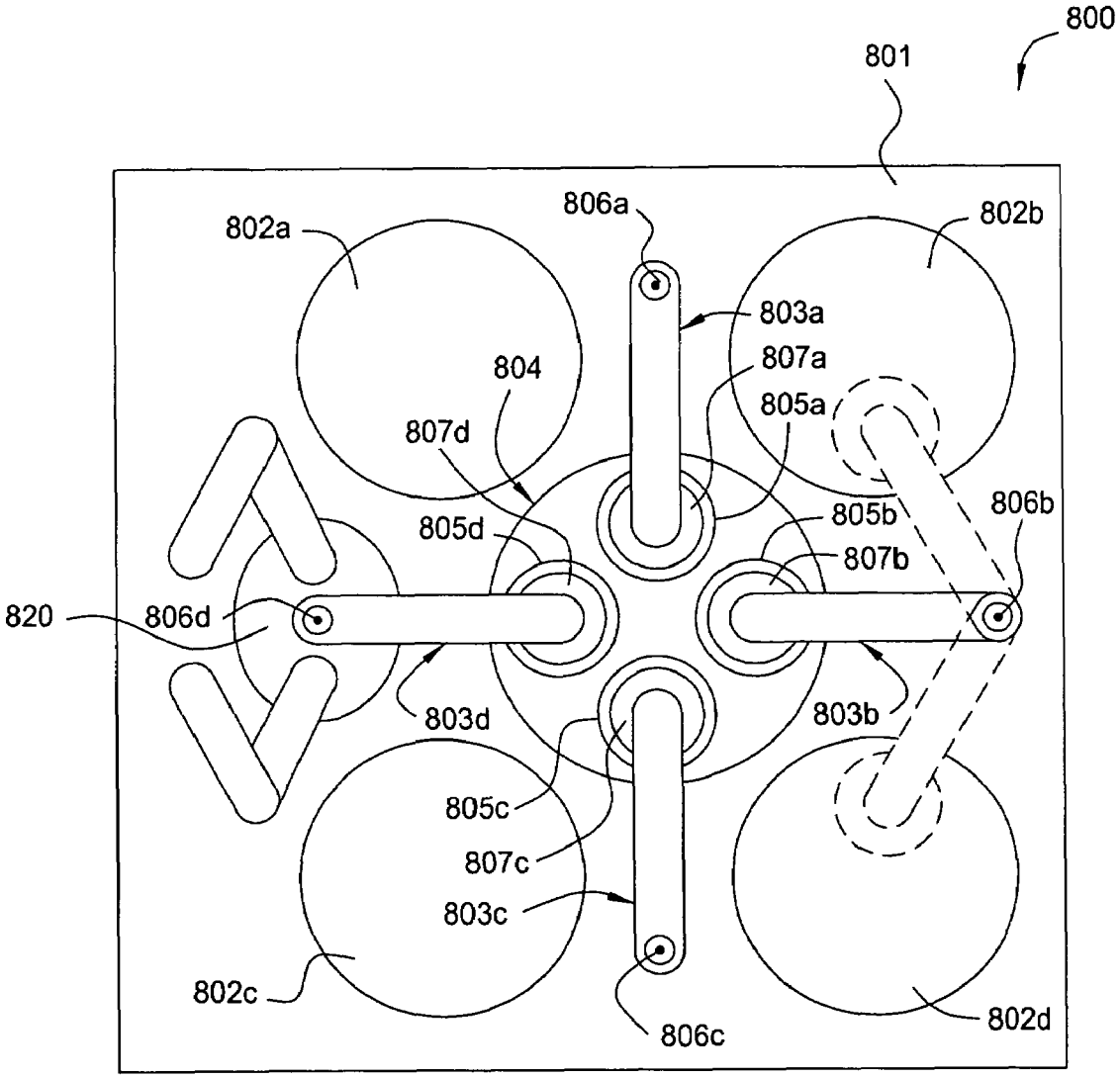
FIG. 11 illustrates a schematic top view of a polishing system in accordance with the present invention.

FIG. 11 illustrates a schematic top view of a polishing system 800 in accordance with one embodiment of the present invention. The polishing system 800 generally comprises a base 801 that supports four polishing stations 802*a*-802*d*. In one embodiment, the base 801 has a rectangular shape and the polishing stations 802*a*-802*d* are disposed near the corners of the base 801. The polishing system 800 further comprises a load cup carousel 804 generally disposed near the center of the base 801. The load cup carousel 804 is rotatable about its center so that four load cups 805*a*-805*d* disposed on the load cup carousel 804 rotates and exchangeable. The polishing system 800 further comprises four independent wafer head systems 803*a*-803*d*. Each of the wafer head systems 803*a*-803*d* is pivotable about a pivot point 806*a*-806*d* so that a wafer head 807*a*-807*d* moves between polishing stations and load cups. Each of the wafer heads 807*a*-807*d* has access to the two neighboring polishing stations, as shown in dotted line for the polishing head 805*b*. A robot 820 may be used to pick up and drop off a wafer from the most accessible load cups. In one embodiment, the robot 820 shares the pivot point 806*d* with the wafer head system 803*d*.

During process, the robot 820 drops off a wafer on one of the load cups 805*a*-805*d*. The load cup carousel 804 then rotate so that the wafer on the load cup is accessible to the intended wafer head, which then loads up the wafer, pivots towards the corresponding polishing station and conduct a polishing process. Since each wafer heads have access to two polishing stations, the polishing system 800 is capable of conducting a two step process with only one wafer loading/unloading, therefore improves throughput. Additionally, the load cup carousel 804 eliminates wafer transferring from one load cup to another, hence prevents cross contamination due to wafer exchange among the load cups. The polishing system 800 is particularly effective for a batch process of two step polishing.

While the foregoing is directed to embodiments of the present invention, other and further embodiments of the invention may be devised without departing from the basic scope thereof, and the scope thereof is determined by the claims that follow.

What is claimed is:

1. A method for polishing semiconductor substrates, comprising:

providing a first load cup;

providing a first polishing station configured to perform a first polishing step;

providing a second polishing station configured to perform a second polishing step;

providing first and second pivot arms independently pivotable about a first pivot point and configured to carry substrates among the first load cup and the first and second polishing stations;

providing a second load cup;

providing a third polishing station configured to perform the second polishing step;

providing a fourth polishing station configured to perform a third polishing step;

providing third and fourth pivot arms independently pivotable about a second pivot point and configured to carry substrates among the second load cup, the third and fourth polishing stations;

performing the first polishing step to a first substrate by pivoting the first pivot arm over the first polishing station;

performing the second polishing step to the first substrate by pivoting the first pivot arm over the second polishing station while performing the first polishing step to a second substrate by pivoting the second pivot arm over the first polishing station;

transferring the second substrate to the third pivot arm; and performing the second polishing step to the second substrate by pivoting the third pivot arm over the third polishing station.

2. The method of claim 1, further comprising:

transferring the first substrate to the fourth pivot arm; and performing the third polishing step to the first substrate by pivoting the fourth pivot arm over the fourth polishing station; and performing the third polishing step to the second substrate by pivoting the third pivot arm over the fourth polishing station.

3. The method of claim 1, wherein transferring the second substrate to the third pivot arm comprises:

disposing the second substrate on the first load cup by pivoting the second pivot arm over the first load cup;

moving the second substrate from the first load cup to the second load cup using a robot; and mounting the second substrate on the third pivot arm by pivoting the third pivot arm over the second load cup.

4. The method of claim 1, wherein performing the first polishing step to the first substrate comprises:

retaining the first substrate on a first carrier head mounted on the first pivot arm;

rotating the first carrier head; and oscillating the first carrier head, and performing the first polishing step to the second substrate comprises:

retaining the second substrate on a second carrier head mounted on the second pivot arm;

rotating the second carrier head; and oscillating the second carrier head.

5. The method of claim 4, wherein oscillating the first carrier head comprises pivoting the first pivot arm back and forth over the first polishing station, and oscillating the second carrier head comprises pivoting the second pivot arm back and forth over the first polishing station.

* * * * *

UNITED STATES PATENT AND TRADEMARK OFFICE

CERTIFICATE OF CORRECTION

PATENT NO. : 7,273,408 B2
APPLICATION NO. : 11/438,497
DATED : September 25, 2007
INVENTOR(S) : Hung Chih Chen and Steven M. Zuniga It is certified that error appears in the above-identified patent and that said Letters Patent is hereby corrected as shown below:

Column 7, line 59, please delete "306a/306b" and insert --306a/305b, 306b--

Signed and Sealed this

Seventeenth Day of June, 2008

JON W. DUDAS
*Director of the United States Patent and Trademark Office*